US009484611B2

(12) United States Patent
Forstmaier

(10) Patent No.: US 9,484,611 B2
(45) Date of Patent: Nov. 1, 2016

(54) COUPLED LINE SYSTEM WITH CONTROLLABLE TRANSMISSION BEHAVIOUR

(71) Applicant: Rohde & Schwarz GmbH & Co. KG, Munich (DE)

(72) Inventor: Rudolf Forstmaier, Dorfen (DE)

(73) Assignee: ROHDE & SCHWARZ GMBH & CO. KG, Munich (DE)

( * ) Notice: Subject to any disclaimer, the term of this patent is extended or adjusted under 35 U.S.C. 154(b) by 52 days.

(21) Appl. No.: 14/264,213

(22) Filed: Apr. 29, 2014

(65) Prior Publication Data

US 2014/0320238 A1 Oct. 30, 2014

(30) Foreign Application Priority Data

Apr. 29, 2013 (DE) ..... 10 2013 207 835
Jul. 30, 2013 (DE) ..... 10 2013 214 818

(51) Int. Cl.
*H01P 1/15* (2006.01)
*H01P 3/02* (2006.01)
*H01P 5/18* (2006.01)
*H01P 1/203* (2006.01)

(52) U.S. Cl.
CPC ..... *H01P 3/02* (2013.01); *H01P 3/026* (2013.01); *H01P 1/2039* (2013.01)

(58) Field of Classification Search
CPC ..... H01P 5/18; H01P 5/184; H01P 5/185; H01P 5/187
USPC ..... 333/109, 111, 112, 116, 238
See application file for complete search history.

(56) References Cited

U.S. PATENT DOCUMENTS 3,575,674 A * 4/1971 Howe, Jr. ..... H01P 5/187 333/116
3,659,227 A 4/1972 Whistler
4,394,630 A * 7/1983 Kenyon ..... H01P 5/187 333/116
5,307,032 A 4/1994 Uno
5,363,071 A * 11/1994 Schwent ..... H01P 5/187 333/116
5,539,362 A * 7/1996 Culling ..... H01P 5/184 333/116
6,225,874 B1 5/2001 Kerley
6,686,808 B1 * 2/2004 Sugawara ..... H01P 1/211 333/1
7,321,276 B2 * 1/2008 Nichols ..... H01P 5/185 333/109
2010/0225416 A1 * 9/2010 Ingalls ..... H01P 5/184 333/116
2012/0049985 A1 3/2012 Kawai et al.

FOREIGN PATENT DOCUMENTS

DE 19902346 A1 12/1999

* cited by examiner

*Primary Examiner* — Dean Takaoka
(74) *Attorney, Agent, or Firm* — Ditthavong & Steiner, P.C.

(57) ABSTRACT

The invention relates two lines each with two terminals. A first line provides a first terminal and a second terminal. A second line provides a first terminal and a second terminal. The lines extend in spatial proximity and are coupled. The two lines transport an electromagnetic signal fed into the line system. Distanced from the first terminal of the second line and distanced from the second terminal of the second line, at least one controllable element is arranged along the second line. The invention further relates to a switch, a controllable diplexer, a controllable frequency filter, a controllable attenuator and a controllable phase shifter.

24 Claims, 17 Drawing Sheets

DB(|S(2,1)|)
Elements E: High impedance
DB(|S(2,3)|)
Elements E: High impedance
DB(|S(2,1)|)
Elements E: Low impedance
DB(|S(2,3)|)
Elements E1 - Ex: High impedance, Elements Ex+1 - En: Low impedance

COUPLED LINE SYSTEM WITH CONTROLLABLE TRANSMISSION BEHAVIOUR

FIELD OF THE INVENTION

The invention relates to a line system with coupled lines for the transmission of electromagnetic signals. In this context, the line system can be used as a switch, as a controllable diplexer, a controllable frequency filter, a controllable attenuator and a controllable phase shifter.

BACKGROUND OF THE INVENTION

Switches in radio-frequency technology, for example, as described in the US patent specifications U.S. Pat. No. 6,225,874 B1 and U.S. Pat. No. 5,307,032, can be realized through a coupled line system. At these line systems, switching elements are disposed in each line. The switching elements are arranged exclusively at the inputs and outputs of the line system. With these switches, a low insertion loss of an electromagnetic signal to be transported is desirable for the respective switching path. Because of the always present parasitic inductances and capacitances of the switching elements, this low insertion loss can no longer be achieved for these switches in the case of very high frequencies—especially in the multiple-digit gigahertz range.

In this context, the selection of the respective switching path is implemented by means of a DC voltage or a DC current. However, in radio-frequency technology, it is desirable for the inputs, or respectively outputs, of a switch to be free of DC voltage and DC current. Furthermore, it should not be possible to vary the selection of the switching path through an external DC voltage source at the inputs respectively outputs of the line system. In order to achieve this, a coupling capacitor is inserted at the inputs and outputs of the switch. These coupling capacitors have a lower limit frequency determined by the capacitance value. If the switch is to be usable from a low bottom limit frequency up to a high top limit frequency, these coupling capacitors must be resonance free and must have a low insertion loss over this frequency range. With currently available coupling capacitors, this is not realizable. As a result of the coupling capacitor, the lower limit frequency cannot be zero, so that a DC voltage cannot be transmitted via such a switch.

Switching over the switching path is implemented by changing a DC control voltage respectively a DC control current. This causes voltage peaks at the inputs and outputs of the coupled line system. Such so-called video crosstalk can be very high and is undesirable.

In US patent specifications U.S. Pat. No. 6,225,874 B1 and U.S. Pat. No. 5,307,032, the switching elements used for switching the lines are disposed exclusively at the inputs and outputs of every line of the line system. Accordingly, a switching element is also disposed in the line which is connected to the output of the switch. This causes an increased video crosstalk which is undesirable. Additionally, wideband coupling capacitors, which cannot be realized with low insertion loss and in a resonance free manner, are necessary.

In order to achieve a low insertion loss of a signal to be transported via a coupled line system, a strong coupling between the lines is necessary at the line systems described in US patent specifications U.S. Pat. No. 6,225,874 B1 and U.S. Pat. No. 5,307,032. Coupled line systems with a strong coupling between the coupled lines are significantly more difficult to realize than coupled line systems with weak coupling between the coupled lines. As a result of the strong coupling, a high radio-frequency current flows through the switching elements which are switched to a low impedance. As a result of the power dissipation accordingly occurring in the switching elements, the maximal radio-frequency input power of such switches is severely limited. Because of the high radio-frequency current through the switching elements, the radio-frequency parameters of the switching elements are strongly modulated. This leads to nonlinear distortions which are undesirable.

Accordingly there is a need to provide a line system with coupled lines which overcomes the disadvantages identified above. In particular, the coupled line system should provide a low insertion loss and a low attenuation of the signal to be transported. In this context, the line system should be able to transport both DC-voltage signals, signals with low frequency and also signals with a very high frequency—especially in the multiple-digit gigahertz range. In particular, the line system according to the invention should be usable for the transportation of signals with a high radio-frequency power as well as low nonlinear distortions and low video crosstalk.

SUMMARY OF THE INVENTION

The need is achieved, in particular, by a line system with at least two lines each with two terminals. In this context, a first line provides a first terminal and a second terminal. Accordingly, a second line provides a first terminal and a second terminal. The lines extend in spatial proximity and are coupled. The at least two lines transport an electromagnetic signal fed into the line system. In this context, the lines are embodied in such a manner that, distanced from the first terminal of the second line and distanced from the second terminal of the second line, at least one controllable element is arranged along the second line.

In this context, a line is understood to be any transmission line which can be described by a characteristic impedance and a complex propagation constant gamma ($\gamma$). The complex propagation constant gamma is formed from the attenuation constant alpha ($\alpha$) and the phase constant beta ($\beta$). The phase constant beta is determined through the phase velocity and the frequency of a signal to be transported via this line. Consequently, alongside conductor structures explicitly embodied on a substrate—especially microstrip lines, striplines or coplanar lines—, also slotlines, waveguides, substrate-integrated waveguides (acronym: SIW) or dielectric waveguides are provided as lines according to the invention.

The characteristic impedance and the complex propagation constant of the lines can be dependent upon position and frequency. The line according to the invention is defined by a first terminal and a second terminal, whereas external signals can only be fed in or tapped at these terminals. An externally defined termination, for example, a load impedance or a short-circuit, can only be connected at these terminals. Accordingly, a line can comprise several line segments.

The line can contain passive, non-controllable elements, especially resistors, capacitors, inductors, which can be realized as discrete components or as line structures. In particular, the various lines can also be of different lengths. Especially, the coupling range between different lines can be of a different length.

An electromagnetic signal fed into the coupled line system can be displayed through superposition of an even mode and an odd mode signal. In the case of the even mode, the signal fed in is present in the lines of the line system simultaneously with identical phase. In the case of the odd mode, the signal is simultaneously present in phase opposition, that is to say, rotated by 180°, in the lines of the line system. The even mode, and therefore also the corresponding even mode wave transported via the line system, are propagated between the at least two coupled lines and a reference potential of the signal. The odd mode, and accordingly also the corresponding odd mode wave transported via the line system in this context, are primarily propagated between the coupled lines. Accordingly, the even mode and the odd mode of the electromagnetic signal fed in and to be transported are propagated in different spatial regions of the line system.

An even mode characteristic impedance and an even mode complex propagation constant are allocated to the even mode. Correspondingly, an odd mode characteristic impedance and an odd mode complex propagation constant are allocated to the odd mode.

A distanced arrangement of the controllable elements is understood according to the invention to mean that the controllable element is not arranged directly at a first terminal or at a second terminal of the second line. The controllable element is positioned along the second line. Accordingly, in an advantageous manner, a local detuning of the characteristic impedance of the second line is achieved, thereby varying the transmission behavior of the line system. Through this variation, the signal fed in is transported through the line system with a lower insertion loss than in the case of a line system without the controllable element.

According to the invention, the at least one controllable element is embodied at least between a low impedance value and a high impedance value in a controllable manner. A DC control voltage is preferably used for this purpose. According to the invention, the controllable element can be controlled to a plurality of complex impedance values. For this purpose, the level of the DC control voltage is varied in order to obtain different complex impedance values of the controllable element. According to the invention, the impedance of the controllable element can be controlled continuously with a DC control voltage.

Through the control of the complex impedance of the at least one controllable element, the characteristic impedance and the complex propagation constant of the line on which the controllable element is disposed is varied locally. As a result, the characteristic impedance and/or the complex propagation constant of the even mode and the odd mode are varied.

Since the even mode and the odd mode of the signal to be transported are primarily propagated spatially in different regions, the characteristic impedance and the complex propagation constant of the even mode and the odd mode are different. As a result of the different complex propagation constants and the resulting phase velocities of the even mode and the odd mode, the even mode and the odd mode are superposed in a constructive or respectively destructive manner dependent upon the frequency of the signal fed in and the position of the signal to be transported on the lines. The level of the constructive respectively destructive superposition depends upon the characteristic impedances and complex propagation constants of the lines and the characteristic impedances and complex propagation constants of the even mode and the odd mode.

In particular, with two coupled lines with identical characteristic impedances and identical complex propagation constants and different phase velocities of the even mode and odd mode, the following behavior occurs. When an electromagnetic signal is fed to the first terminal of the second line, at a given relatively higher frequency, a maximal destructive superposition occurs at the second terminal of the second line, and a maximal constructive superposition occurs at the second terminal of the first line. A transmission of the electromagnetic signal from the first terminal of the second line to the second terminal of the first line with low insertion loss takes place at this frequency. This frequency at which the maximal transmission takes place is relatively smaller the longer the line is and the greater the difference between the phase velocities of the even mode and the odd mode is. This behavior also occurs with a relatively wide frequency range close to this frequency. For this behavior, a weak coupling between the lines is sufficient.

Through the control according to the invention of the impedance of the at least one controllable element, the characteristic impedance and the complex propagation constant of the corresponding line are varied locally. In this manner, the characteristic impedance and/or the complex propagation constant of the even mode and odd mode are varied. Accordingly, the superposition of the even mode and the odd mode is varied. In consequence, the transmission behavior of the line system is varied.

In particular, through the control according to the invention of the impedance of the at least one controllable element, a low insertion loss from the second line to the first line can be adjusted. This is also possible in the case of very high frequencies, for example, in the multiple-digit gigahertz range. A radio-frequency signal fed in at the first terminal of the second line can be tapped with a very low insertion loss at the second terminal of the first line. This can be achieved especially by adjusting the impedance of the at least one controllable element in such a manner that the resulting characteristic impedance of the second line and the characteristic impedance of the first line are approximately identical, and the phase velocities of the even mode and the odd mode are different. Accordingly, a high constructive superposition of the even mode and the odd mode can be achieved at the second terminal of the first line. A high destructive superposition of the even mode and the odd mode is adjusted correspondingly at the second terminal of the second line. For this behavior, a weak coupling between the lines is sufficient.

In particular, through the control according to the invention of the impedance of the at least one controllable element a low insertion loss from DC voltage up to very high frequencies from the first terminal of the first line to the second terminal of the first line can be adjusted. This can be achieved, in particular, by adjusting the impedance of the at least one controllable element in such a manner that the resulting characteristic impedance of the second line and the characteristic impedance of the first line differ strongly or the phase velocities of the even mode and odd modes are approximately identical.

An additional achievement of the line system according to the invention is that, through the feeding of the signal to the first terminal of the first line and also the feeding of the signal to the first terminal of the second line and the tapping of the transported signal at the second terminal of the first line, the frequency range usable for the transmission with low insertion loss overlaps.

Accordingly, two frequency ranges can be combined with low insertion loss without a frequency gap. The frequency range combined at the second terminal of the first line extends from DC voltage up to very high frequencies—especially in the multiple-digit gigahertz range. Additionally, both the first terminal of the first line and also the first terminal of the second line can be used for the transmission of signals in the overlapping frequency range, so that the line system can be used in a more flexible manner. The use of wideband coupling capacitors is advantageously not required. Without the control according to the invention of the impedance of the at least one controllable element, an overlapping frequency range with low insertion loss would not be possible.

With the line system according to the invention, a low insertion loss can be achieved between terminals of different lines. A weak coupling between the lines is sufficient for this. In consequence, the radio-frequency currents in the controllable elements are low, so that the power dissipation generated in the controllable elements is low. The line system can therefore be used for very high radio-frequency power levels. Furthermore, as a result of the low radio-frequency currents, the nonlinear distortions are also low.

Advantageously, no controllable elements are required in the first line. As a result, the use of wideband coupling capacitors is not required, although, especially at the second terminal of the first line, frequencies from DC voltage up to very high frequencies can be combined there. Since no controllable elements—which could cause video crosstalk—are required in the first line, and a weak coupling between the lines is sufficient, the video crosstalk at the terminals of the first line is also very low.

The transmission behavior of the line system is advantageously adaptable to different transmission scenarios. For this purpose, only the characteristic impedance of the second line must be controlled through targeted variation of the impedances of the controllable elements. For this purpose, the controllable elements need not necessarily provide a very low impedance or a very high impedance. As a result, necessarily existing parasitic inductances and parasitic capacitances of the controllable elements are also less disturbing even at very high frequencies. In particular, existing parasitic elements of the controllable elements can also be compensated through matching of the line geometry and/or through addition of passive, non-controllable elements and/or line structures in the lines. As a result, the line system can be used up to very high frequencies—especially in the multiple-digit gigahertz range.

The line system can therefore be used in a very flexible manner for different application scenarios, especially with different signal frequencies of the signal to be fed, without the need to implement geometric changes or additional switches at the terminals of the lines of the line system in order to transmit the signal via the line system with low insertion loss.

In particular, several controllable elements are preferably arranged along the line. Controllable elements can especially be additionally arranged at the terminals of the line. The controllable elements are arranged, for example, equidistantly. Alternatively, the controllable elements are arranged with a defined—and optionally different—distance from one another. The number of elements is not restricted in this context. Through the arrangement of a plurality of controllable elements, the transmission behavior of the line system can be further controlled.

The controllable elements can all be embodied in an identical manner. Alternatively, different controllable elements which differ through their internal construction, and therefore influence the transmission behavior differently, are used. Additionally, with the use of different controllable elements, the transmission behavior of the line system can be further varied. In this context, the impedance value of every element individually, or respectively of groups of elements and/or of all elements arranged along the second line simultaneously, can be varied.

Through the control according to the invention of the impedance values of the controllable elements, the characteristic impedance and the complex propagation constant of the line are varied locally. This results in a position-dependent variation of the characteristic impedances and/or of the complex propagation constants of the even mode and the odd mode. This position-dependent variation leads to a very precise matching and adjustment of the transmission behavior of the line system. In particular, as a result, a low insertion loss in the transportation of an electromagnetic signal from the first terminal of the second line to the second terminal of the first line over a very wide frequency range is achieved.

By preference, the controllable element is controllable dependent upon the frequency of the electromagnetic signal fed in and/or dependent upon the terminal of the lines used for feeding in the signal. This means, advantageously, that signals of high frequencies and also of DC voltage can be transmitted via the line system, whereas a very low insertion loss of the line system is achieved constantly. The use of wideband coupling capacitors is not required in this context.

In a preferred embodiment, the at least one controllable element is connected with a first terminal on the second line and with a second terminal to a reference potential of the signal fed in the line system. In this context, at least the second line is embodied as an explicit conductor. Such conductors are, in particular, microstrip lines, striplines or coplanar lines. By varying the impedance of the at least one controllable element, the characteristic impedance and the complex propagation constant of the second line are varied locally, thereby controlling the transmission behavior of the line system.

In an alternative embodiment, the second line in the line system is without an explicitly embodied conductor. In this context, the at least one controllable element is arranged in such a manner that the electromagnetic field of the line system is significantly changed through the variation of the impedance of the controllable element. Accordingly, the characteristic impedance and the complex propagation constant of the second line and/or the coupling between the lines are varied, thereby varying the transmission behavior of the line system. Lines without explicit conductors are, in particular, slotlines, waveguides or SIW lines. Especially when slotlines are used, the controllable elements are arranged transversely over the slot.

The DC voltage, respectively the DC current, for controlling the impedance change of the controllable element is preferably supplied via the terminals of the coupled lines. Alternatively, a DC voltage, respectively a DC current, is supplied to the element internally, especially by means of a separate control terminal. In particular, the controllable elements contain capacitors for decoupling the DC voltage. A coupling capacitor is introduced longitudinally into the second line, especially between controllable elements. In this manner, a decoupling of the DC voltage is achieved, so that the controllable elements are advantageously controllable independently of one another.

In particular, the controllable element contains a PIN diode. The impedance of the PIN diode is adjustable through a DC control current. PIN diodes can be used up to very high frequencies—for example, in the two-digit gigahertz range.

The controllable element contains, especially, a field-effect transistor (acronym: FET) or a bipolar transistor. The impedance of the FETs respectively of the bipolar transistor is adjustable through a DC control voltage.

In particular, the controllable element contains a varactor. The capacitance, and consequently the impedance, of the varactor is adjustable through a DC control voltage.

The controllable element contains, especially, an electromechanical switch, for example, a Micro-Electro-Mechanical System (acronym: MEMS) switch. The impedance of the electromagnetic switch is controllable through a DC control voltage between a low and a high impedance value.

In particular, the impedances of the controllable elements can be controlled through a DC control current, respectively DC control voltage, between two, several or a plurality of impedance values. The impedances can be varied especially in a continuous manner. Accordingly, the characteristic impedance of the second line can be adjusted locally with very high precision.

Alternatively or additionally, the controllable element contains a coupling capacitor. These embodiments have the advantage that the controllable element is decoupled with reference to a DC voltage which is to be transported on the lines of the line system or which is used for the control of other controllable elements. By preference, these coupling capacitors are realized either as discrete components or as line structures. In particular, the controllable elements can contain further line structures.

By preference, the first line is free from controllable elements which could restrict the radio-frequency power level, generate nonlinear distortions and video crosstalk. Furthermore, the use of wideband coupling capacitors is not required. Accordingly, a DC voltage signal can be transmitted via the first line.

The coupled lines of the line system according to the invention are preferably arranged in a layered carrier substrate, whereas at least one layer of the substrate provides an electrical dielectric constant and/or relative magnetic permeability different from the other layers of the substrate.

In a preferred embodiment of the invention, a homogenous carrier substrate is surrounded by another medium, especially air. In particular, the lines are disposed above, respectively above and below, this homogenous carrier substrate. As a result of the spatially different propagation of the even mode and the odd mode and the accordingly different phase velocities of the even mode and the odd mode, the transmission behavior of the line system can be additionally adapted.

In a preferred embodiment, the lines additionally provide passive, non-controllable elements, especially additional resistors, capacitors and/or inductors, which are realized as discrete components or as line structures. These passive non-controllable elements can be arranged as longitudinal elements, within the line, or from the line to the reference potential, or between the lines. As a result, the transmission behavior can be additionally adapted.

In particular, the transmission behavior of the line system is additionally varied through the line widths, the line thicknesses, the distances of the lines from one another, the distances of the lines from the reference potential and/or the material constants of the media, especially the electrical dielectric constants and/or the relative magnetic permeabilities in which the signal is transported.

Alternatively or additionally, the lines provide line structures. Alternatively or additionally, the transmission behavior is variable through a comb structure or zigzag structure between the lines, through line segments in the lines, through capacitances, as a component or as line structure, between the lines, respectively relative to the reference potential, through an additional material with different electrical dielectric constant and/or relative magnetic permeability in the proximity of the lines, through slots in the reference ground surface, through coupled lines in a U-shape and/or through a layered carrier substrate.

In order to achieve an advantageous transmission behavior of the line system, the measures for varying the difference between the phase velocities of the even mode and odd mode can vary in a position-dependent manner along the lines.

In an advantageous embodiment, at least one non-controllable element is connected along the first line for compensation of parasitic impedances of the controllable element connected along the second line. For example, resistors, inductors, capacitors should be provided in this context as a discrete component or as line structure.

In a preferred manner, the lines of the line system are embodied without controllable longitudinal elements. Elements which are connected both to a first terminal and also to a second terminal in the same line of the line system are designated as longitudinal elements. In consequence, the maximal radio-frequency input power is not limited by such controllable longitudinal elements. Furthermore, no nonlinear distortions are generated by such controllable longitudinal elements.

Furthermore, according to the invention, a switch, respectively controllable diplexer, comprising the line system already described is provided. The first terminal of the first, second and respectively further lines are the inputs of the switch. The second terminal of the first line serves as the output of the switch. The second terminal of the second line, respectively the second terminals of the further lines, are left open or terminated with an arbitrary load impedance. The configuration of the coupled lines in this form allows a switch, respectively controllable diplexer, for the transmission of signals, from DC voltage and very low-frequency up to very high-frequency signals. The switch can also be operated in a reciprocal manner, thereby exchanging the inputs and outputs of the switch.

According to the invention, a controllable frequency filter, especially a low-pass, a high-pass, a band-pass, a band-stop filter, a controllable attenuator and/or a controllable phase shifter comprising the line system already described is further provided. In this context, the line system can be operated in a reciprocal manner, whereas, for this purpose, the inputs and outputs of the line system are interchanged. Accordingly, a terminal of a line serves as the input and another terminal of the same, or of another, line serves as the output.

In particular, the first terminal of the first line respectively the first terminal of the second line serves as the input. The second terminal of the first line, especially, serves as the output. The other terminals of the lines are left open or terminated with an arbitrary load impedance.

Alternatively, the first terminal of the first line, respectively the first terminal of the second line, serves as output. In particular, the second terminal of the first line serves as input. The other terminals of the lines are left open or terminated with an arbitrary load impedance.

BRIEF DESCRIPTION OF THE DRAWINGS

In the following, the invention, respectively further embodiments and advantages of the invention, are explained in greater detail with reference to the drawings, whereas the drawings describe only exemplary embodiments of the invention by way of example. Identical components in the drawings are provided with identical reference numbers. The drawings should not be regarded as true to scale, individual elements of the drawings may be illustrated in an oversized respectively oversimplified manner.

The drawings show.

DETAILED DESCRIPTION OF THE PREFERRED EMBODIMENTS

Figure 1:
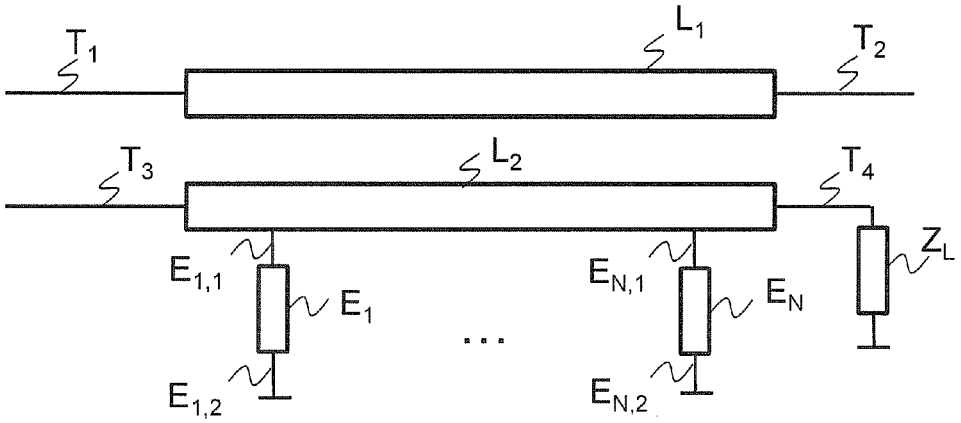
FIG. 1 a first exemplary embodiment of a line system according to the invention.

FIG. 1 shows a line system according to the invention with a first line $L_1$ and a second line $L_2$. Line $L_1$ in this context provides a first terminal $T_1$ and a second terminal $T_2$. The line $L_2$ provides a first terminal $T_3$ and a second terminal $T_4$. The terminal $T_4$ of the second line $L_2$ is terminated with a load impedance $Z_L$. The line system configured in this manner is used as a switch, respectively as a controllable diplexer. Several controllable elements $E_1$ to $E_N$ are arranged along the second line $L_2$. Each of the elements $E_1$ to $E_N$ is distanced from the first terminal $T_3$ of the second line $L_2$. Each of the elements $E_1$ to $E_N$ is distanced from the second terminal $T_4$ of the second line $L_2$. Both the first line $L_1$ and also the second line $L_2$ are embodied as explicit conductors. Each of the elements $E_1$ to $E_N$ is connected with a first connection $E_{1,1}$ $E_{N,1}$ to the second line $L_2$. Each of the elements $E_1$ to $E_N$ is connected with its respective second connection $E_{1,2}$ $E_{N,2}$ to a reference potential Gnd. The impedances of the elements $E_1$ to $E_N$ can be varied by a DC control voltage, respectively DC control current. For this purpose, as shown in FIG. 1, a DC control voltage is applied at the first terminal $T_3$ or the second terminal $T_4$ of the second line $L_2$. Alternatively—not explicitly illustrated in FIG. 1—the DC control voltage is supplied internally to the controllable element E, especially by means of a separate control connection.

The number of elements E which are arranged along the second line $L_2$ is not restricted in number. For example, twenty elements E are arranged in a line length of the second line $L_2$ of three centimeters. Accordingly, several elements E per millimeter can also be arranged in the second line $L_2$.

An electromagnetic signal can be fed into the line system at the first terminal $T_1$ of the first line $L_1$ and the first terminal $T_3$ of the second line $L_2$. The line system provides an output at the second terminal $T_2$ of the first line $L_1$. The signal transported via the line system is tapped at this output. The signal fed in can be displayed through superposition of an even mode and an odd mode signal. An even mode characteristic impedance and an even mode complex propagation constant are allocated to the even mode. In a corresponding manner, an odd mode characteristic impedance and an odd mode complex propagation constant are allocated to the odd mode.

Since the even mode and the odd mode of the signal to be transported are spatially propagated primarily in different regions, the characteristic impedance and the complex propagation constant of the even mode and the odd mode are different. In consequence of the resulting different phase velocities of the even mode and the odd mode, the even mode and odd mode are superposed in a constructive, respectively destructive, manner dependent upon the frequency of the signal fed in and the position of the signal to be transported on the lines $L_1$ and $L_2$. The level of the constructive, respectively destructive, superposition depends upon the characteristic impedances and the complex propagation constants of the lines $L_1$ and $L_2$ and the characteristic impedances and complex propagation constants of the even mode and the odd mode. In particular, with two weakly coupled lines $L_1$, $L_2$ with identical characteristic impedances and identical complex propagation constants and different phase velocities of the even mode and odd mode, the behavior illustrated in FIG. 2 occurs.

Figure 2:
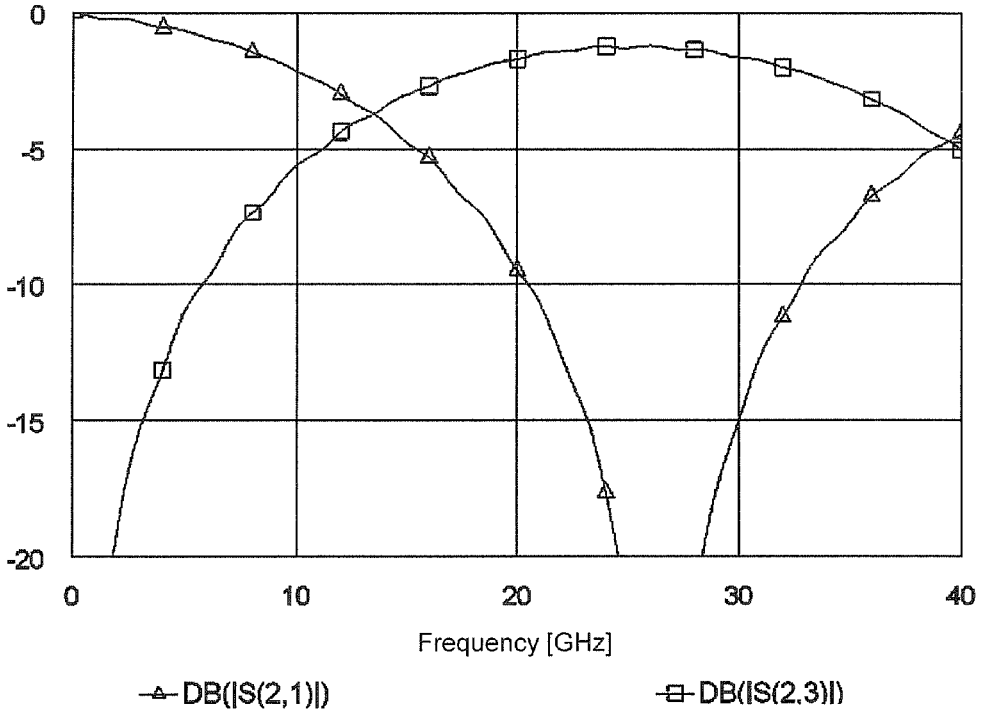
FIG. 2 a transmission characteristic of the line system illustrated in FIG. 1.

FIG. 2 shows the S parameters S(2, 1) from the terminal $T_1$ to terminal $T_2$ on a line with triangles; by contrast, the S parameters S(2, 3) from terminal $T_3$ to terminal $T_2$ are shown with small squares. It is clearly evident that the S parameters S(2, 1) from terminal $T_1$ to terminal $T_2$ behave in an opposite manner to the S parameters S(2, 3) from terminal $T_3$ to terminal $T_2$. It is evident that the S parameters S(2, 1) from terminal $T_1$ to terminal $T_2$ experience a massive insertion loss in the region of relatively higher frequencies, which is explained by a destructive superposition of the even mode and the odd mode at terminal $T_2$ in consequence of a large phase displacement up to 180° between the even mode and the odd mode. However, especially in the case of very low frequencies, the insertion loss from $T_1$ to $T_2$ is very low. By contrast, the insertion loss from the input $T_3$ to the output $T_2$ is substantially better in the case of relatively higher frequencies. The longer the line and the greater the difference between the phase velocities of the even mode and the odd mode is, the lower the frequency is at which a low insertion loss from $T_3$ to $T_2$ is achieved.

Through the arrangement of the elements E along the second line $L_2$ distanced from the terminals $T_3$ and $T_4$ of the second line $L_2$ corresponding to FIG. 1, a local detuning of the characteristic impedance and the complex propagation constant of the second line $L_2$ is caused in the case of an impedance change of the elements E. Accordingly, the characteristic impedance and/or the complex propagation constant of the even mode and the odd mode are varied. Accordingly, the superposition of the even mode and the odd mode is varied. In consequence, the transmission behavior of the line system is varied.

In particular, through the control of the impedances of the elements E from the first terminal $T_3$ of the second line $L_2$ to the second terminal $T_2$ of the first line $L_1$, a low insertion loss can be adjusted. This can be achieved, in particular, by adjusting the impedances of the controllable element E in such a manner that the resulting characteristic impedance of the second line $L_2$ and the characteristic impedance of the first line $L_1$ are approximately identical, and the phase velocities of the even mode and the odd mode are different. At the second terminal $T_2$ of the first line $L_1$, a high constructive superposition of the even mode and the odd mode can accordingly be achieved. For example, the lines $L_1$ and $L_2$ have identical characteristic impedances and identical complex propagation constants, whereas the phase velocities of the even mode and the odd mode are different. If the impedances of the elements E are controlled to a high impedance, the characteristic impedance of the line $L_2$ is hardly influenced and the desired transmission behavior with low insertion loss from the first terminal $T_3$ of the second line $L_2$ to the second terminal $T_2$ of the first line $L_1$ is achieved.

Figure 3:
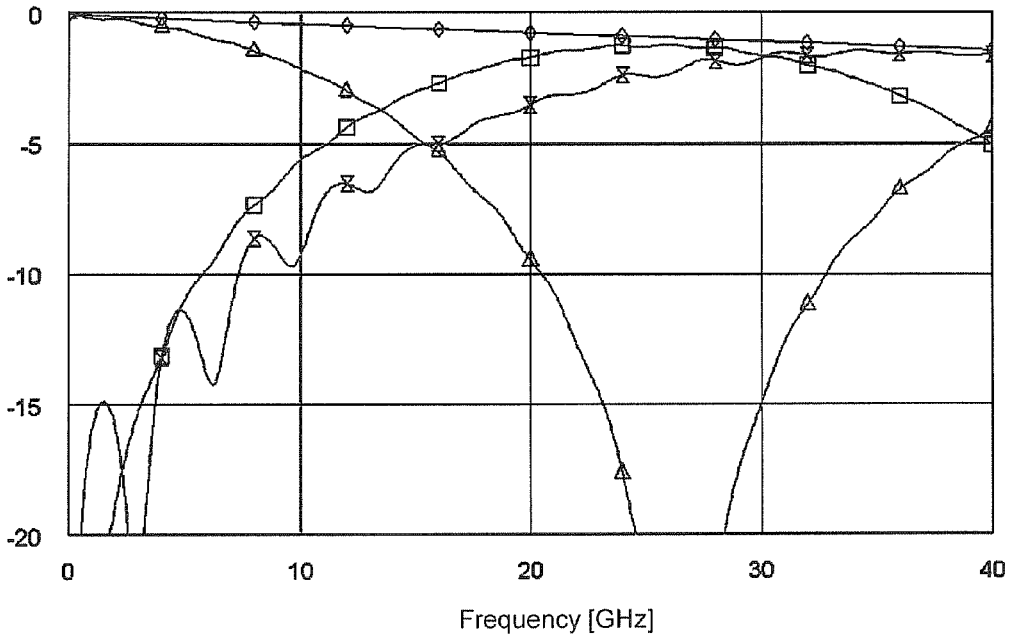
FIG. 3 a transmission characteristic of the line system illustrated in FIG. 1 with an alternative control.

In FIG. 3, this transmission behavior is illustrated for the elements E with high impedance, which is identical to the behavior shown in FIG. 2. Alternatively, this transmission behavior could also be achieved, for example, if the line $L_2$ has a high characteristic impedance and the elements E are controlled to a low impedance, so that the characteristic impedance of the line $L_2$ detuned by the elements E and the characteristic impedance of the line $L_1$ are approximately identical.

In particular, through the control of the impedances of the elements E, a low insertion loss from the first terminal $T_1$ to the second terminal $T_2$ of the first line $L_1$ from DC voltage up to very high frequencies can be adjusted. This can be achieved, in particular, by adjusting the impedances of the elements E in such a manner that the resulting characteristic impedance of the second line $L_2$ and the characteristic impedance of the first line differ strongly, or the phase velocities of the even mode and the odd mode are approximately identical. For example, this can be achieved by controlling the elements E to a low impedance. Accordingly, the characteristic impedance of the line $L_2$ is strongly detuned.

In FIG. 3, the S parameters from $T_1$ to $T_2$ are illustrated by the characteristic with rectangles tilted onto their corners. As an alternative, this transmission behavior could also be achieved, for example, if the line $L_2$ has a high characteristic impedance, and the elements are controlled to a high impedance, so that the characteristic impedance of the line $L_2$ retains its high characteristic impedance, and accordingly, the characteristic impedances of the lines $L_1$ and $L_2$ are strongly different.

In FIG. 1, terminal $T_4$ of the second line $L_2$ of the line system is terminated with a load impedance $Z_L$. The line system configured in this manner is used as a switch, respectively as a controllable diplexer. At the first terminal $T_1$ of the first line $L_1$, a signal from DC voltage up to very high frequencies is applied, whereas, at the first terminal $T_3$ of the second line $L_2$, a radio-frequency signal from high to very high frequencies—up to a frequency in the multiple-digit gigahertz range—is applied. Accordingly, $T_1$ and $T_3$ represent inputs of the switch. Both the signal from terminal $T_1$ and the signal from terminal $T_3$ can be tapped at the second terminal $T_2$ of the first line $L_1$. $T_2$ therefore represents an output of the switch. Terminal $T_4$, as shown in FIG. 1, is terminated with a load impedance, can also be short-circuited or left open in order to improve the transmission behavior of the line system. The switch can also be operated in a reciprocal manner, whereas terminal $T_2$ is the input and terminals $T_1$ and $T_3$ are the outputs.

With the line system according to the invention, as a result of feeding in the signal at the first terminal $T_1$ of the first line $L_1$ and at the first terminal $T_3$ of the second line $L_2$ and tapping the transported signal at the second terminal $T_2$ of the first line $L_1$, the frequency range usable for the transmission with a low insertion loss overlaps. Accordingly, for example, a signal in the frequency range from DC voltage (0 Hz) up to 40 GHz is fed in at the first terminal $T_1$ of the first line $L_1$, and a signal in the frequency range from 20 GHz to 30 GHz is fed in at the first terminal $T_3$ of the second line $L_2$. According to the invention, both signals experience no significant insertion loss. Signals in the frequency range between 20 GHz and 30 GHz can be fed in at both first terminals $T_1$ and $T_3$, whereas the transported signal can be tapped at terminal $T_2$ of the first line without significant insertion loss. Accordingly, the frequency ranges can be combined with low insertion loss without frequency gap. The frequency range combined at the second terminal $T_2$ of the first line $L_1$ extends from DC voltage up to 40 GHz. Without the control according to the invention of the impedance of the elements E, an overlapping frequency range with low insertion loss, respectively the combining of frequency ranges with low insertion loss without frequency gap would not be possible.

A low insertion loss from the first terminal $T_3$ of the second line $L_2$ to the second terminal $T_2$ of the first line $L_1$ is achieved through constructive superposition of the even mode and the odd mode at the terminal $T_2$ of the first line $L_1$. For this purpose, a weak coupling between the lines $L_1$ and $L_2$ is sufficient. As a result, the radio-frequency currents in the controllable elements E in the line $L_2$ are low, so that the switch can be used for very high radio-frequency power levels, for example, greater than 10 W, and the nonlinear distortions are low.

No controllable elements E are present in the first line $L_1$. Consequently, the use of a wideband coupling capacitor at the second terminal $T_2$ of the first line $L_1$ is not required, although frequencies from DC voltage up to 40 GHz can be combined there. Since no controllable elements E which could generate video crosstalk are present in the first line $L_1$, and a weak coupling between the lines is sufficient, the video crosstalk at the terminals $T_1$ and $T_2$ of the first line $L_1$ is, furthermore, very low.

The transmission behavior of the line system is advantageously adaptable to different transmission scenarios. For this purpose, only the characteristic impedance of the second line $L_2$ needs to be varied through targeted variation of the impedances of the controllable elements E. Accordingly, the elements E need not necessarily provide a very low impedance or a very high impedance. Necessarily existing parasitic inductances and parasitic capacitances of the controllable elements E are therefore also less interfering even at very high frequencies. In particular, existing parasitic elements of the controllable elements E can also be compensated by matching the line geometry and/or by adding passive, non-controllable elements at the line $L_1$. Consequently, the line system can be used up to very high frequencies—especially in the multiple-digit gigahertz range.

For the switch illustrated in FIG. 1, a further improvement of the S parameters from terminal $T_3$ to terminal $T_2$ can be achieved by controlling some of the controllable elements E to a high impedance value and some to a low impedance value. In this context, the first group of controllable elements E, which are disposed close to the first terminal $T_3$ of the second line $L_2$, is controlled to a high impedance value, while the second group of controllable elements E, which are disposed close to the second terminal $T_4$ of the second line $L_2$, is controlled to a low impedance value.

A corresponding characteristic is illustrated in FIG. 3 with the double, inverted triangles. The coupled lines can be imagined to be subdivided into two regions. In the first region, in which elements have a high impedance value, the transmission of the electromagnetic signal from the second line $L_2$ to the first line $L_1$ takes place through constructive superposition of the even mode and the odd mode. Since the first region is shorter than the line as a whole, the transmission takes place only at a higher frequency. In the second region, in which the controllable elements E have a low impedance value, the transmission of the electromagnetic signal on the line $L_1$ takes place with a low insertion loss. Consequently, for the line system controlled in this manner, a low insertion loss from terminal $T_3$ to terminal $T_2$ is achieved with a higher frequency.

It is evident that the insertion loss can be substantially improved through corresponding control of the impedance value of the controllable elements E, whereas signals from DC voltage up to very high frequencies can be transmitted. From terminal $T_1$ to terminal $T_2$, a low insertion loss from DC voltage up to 40 GHz is obtained if all controllable elements E are controlled to a low impedance. In FIG. 3, the S parameters from $T_1$ to $T_2$ are illustrated by the characteristic with rectangles tilted onto their corners. From terminal $T_3$ to terminal $T_2$, a low insertion loss from 20 GHz up to 40 GHz is obtained. In this context, all controllable elements E are controlled to a high impedance, expediently within the range from 20 to 30 GHz. As a result, a transmission behavior corresponding to the squared characteristic with low insertion loss from 20 to 30 GHz is obtained. From 30 GHz up to 40 GHz, the first group of controllable elements E which are disposed close to the first terminal $T_3$ of the second line $L_2$ are controlled to a high impedance value, while the second group of controllable elements E, which are disposed close to the second terminal $T_4$ of the second line $L_2$, are controlled to a low impedance value. Accordingly, a low insertion loss is obtained from 30 to 40 GHz. The transmission behavior is illustrated by the characteristic with the double, inverted triangles.

Figure 4:
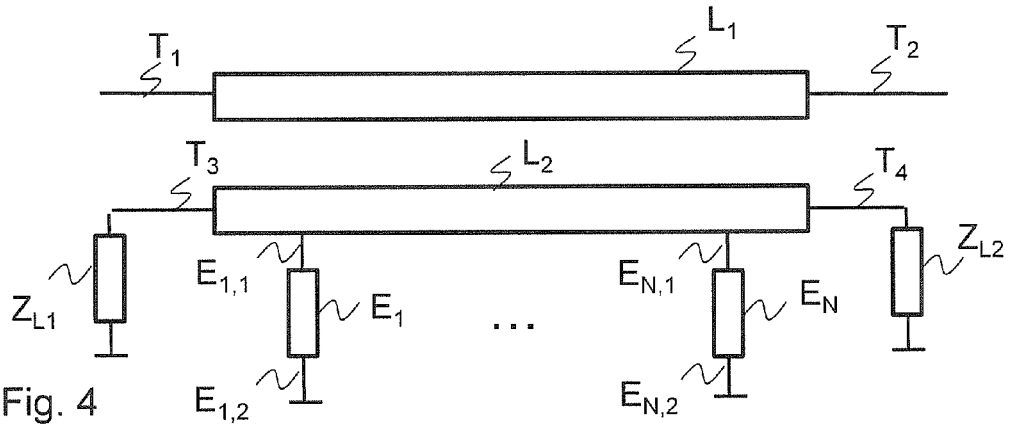
FIG. 4 a second exemplary embodiment of a line system according to the invention.

FIG. 4 shows a further exemplary embodiment of the line system according to the invention. By way of difference from FIG. 1, the line system is terminated both at the first terminal $T_3$ of the second line $L_2$ with a load impedance $Z_{L1}$ and also at the second terminal $T_4$ of the second line $L_2$ with a load impedance $Z_{L2}$. This forms a two-port. The first terminal $T_1$ of the first line $L_1$ and the second terminal $T_2$ of the first line $L_1$ form the terminals of the two-port. By controlling the impedance values of the controllable elements E, the transmission behavior of the two-port can be varied. The two-port can be used as a controllable frequency filter, a controllable attenuator and/or a controllable phase shifter.

Figure 5:
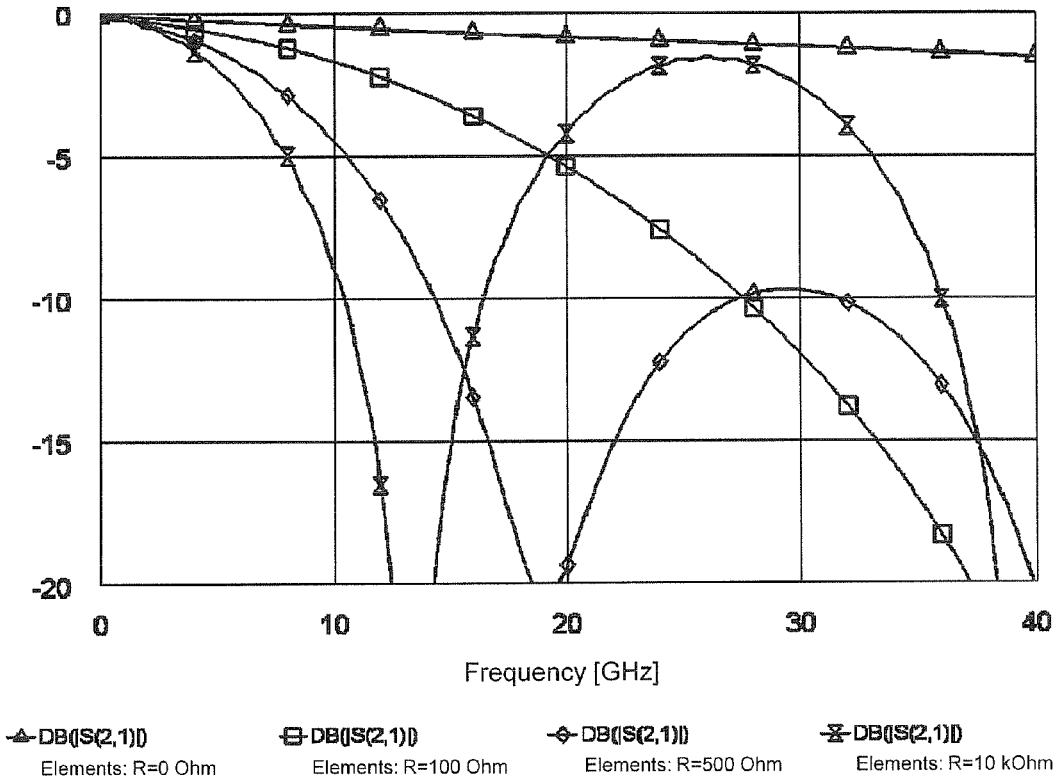
FIG. 5 a transmission characteristic of the line system illustrated in FIG. 4.

FIG. 5 shows the transmission behavior of the two-port shown in FIG. 4, whereas only the real value of the impedance of the controllable elements E is varied. The real impedance value of the controllable elements E is now varied, for example, within a value range from 0 ohms to 10 kiloohms. It is evident from the characteristic with the triangles in FIG. 5, that at 0 ohms, the attenuation from DC voltage up to 40 GHz is low. The characteristic with the squares corresponds to the real value of 100 ohms, the characteristic with rectangles tilted onto their corners corresponds to the real value of 500 ohms and the characteristic with the double, inverted triangles corresponds to the real value of 10 kiloohms. With increasing real impedance of the controllable elements E, the frequency decreases at which a high attenuation occurs for the first time. In the case of the real impedance of 100 ohms, this frequency is disposed at 40 GHz, with 500 ohms at 19 GHz and with 10 kiloohms at 13 GHz. Accordingly, the two-port can be used as a controllable low-pass, respectively controllable band-stop.

Above the first frequency with high attenuation, the attenuation again decreases, and the transmission behavior resembles a band-pass. Accordingly, the two-port can also be used as a controllable band-pass. The attenuation of the two-port at a given frequency can be controlled by controlling the real impedance of the controllable elements E. In this manner, the two-port can also be used as a controllable attenuator. Furthermore, the phase of the two-port can be controlled through the impedance of the controllable elements E, which has not been shown explicitly here. With additional control of the imaginary impedance of the controllable elements E, the transmission behavior can be advantageously adjusted. A further improvement of the transmission behavior can be achieved with different control of the controllable elements E. Furthermore, with a corresponding selection of the impedance $Z_{L1}$ at the terminal $T_3$ and the impedance $Z_{L2}$ at the terminal $T_4$, the transmission behavior of the two-port can be advantageously further adapted.

Since no controllable elements E are present in the line $L_1$, and a weak coupling between the lines $L_1$ and $L_2$ is sufficient, the two-port can be used in an analogous manner to the line system shown in FIG. 1 for very high radio-frequency power levels, as well with low nonlinear distortions and low video crosstalk. Furthermore, it can be used from DC voltage up to very high frequencies.

Figure 6:
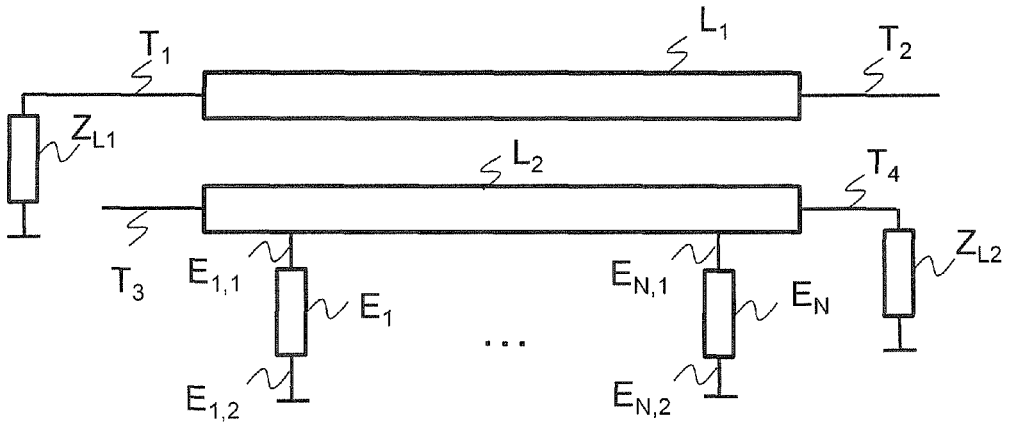
FIG. 6 a third exemplary embodiment of a line system according to the invention.

FIG. 6 shows a further exemplary embodiment of the line system according to the invention. By way of difference from FIG. 4, the line system is terminated at the first terminal $T_1$ of the first line $L_1$ and not at the first terminal $T_3$ of the second line $L_2$ with a load impedance $Z_{L1}$. This forms a further two-port. The first terminal $T_3$ of the second line $L_2$ and the second terminal $T_2$ of the first line $L_1$ form the terminals of the two-port. Through control of the impedance values of the controllable elements E, the transmission behavior of the two-port can be varied so that it can be used as a controllable frequency filter, a controllable attenuator and/or a controllable phase shifter.

Figure 7:
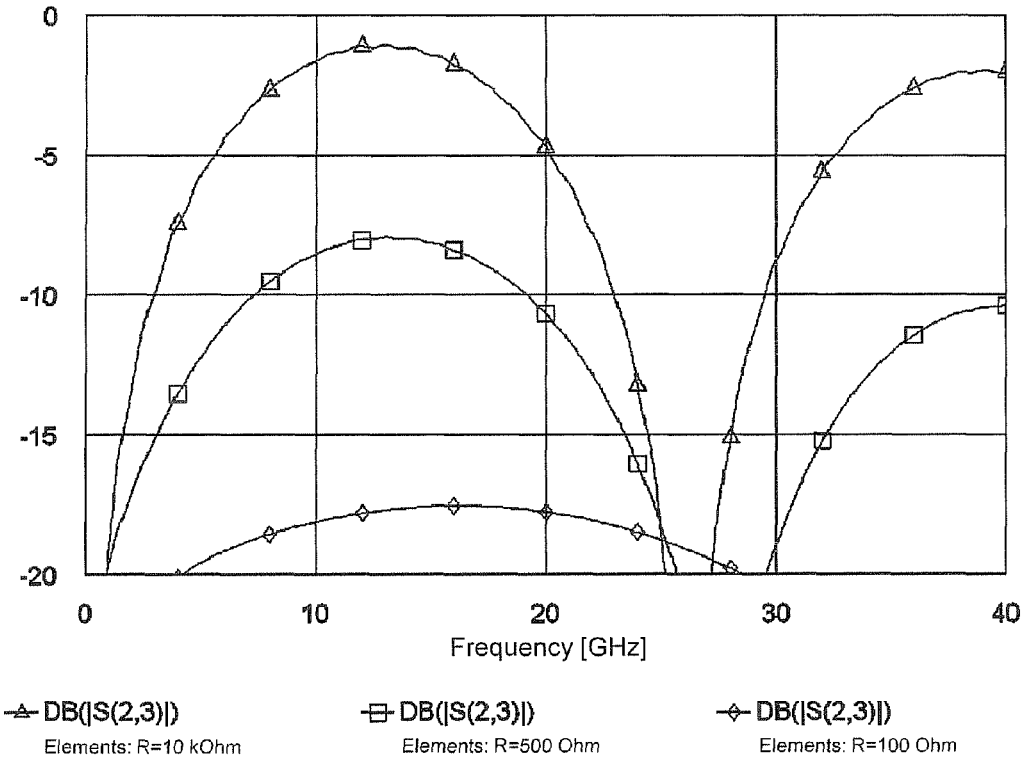
FIG. 7 a transmission characteristic of the line system illustrated in FIG. 6.

FIG. 7 illustrates the transmission behavior of the two-port shown in FIG. 6, whereas the real value of the impedance of the controllable elements E is varied. The real impedance value of the controllable elements E is varied from 100 ohms up to 10 kiloohms. The characteristic with the triangles corresponds to the real value of 10 kiloohms, the characteristic with the squares to the real value of 500 ohms and the characteristic with the rectangles tilted onto their corners to the real value of 100 ohms. With decreasing real impedance, the attenuation rises. The two-port controlled in this manner can be used as a controllable attenuator.

Figure 8:
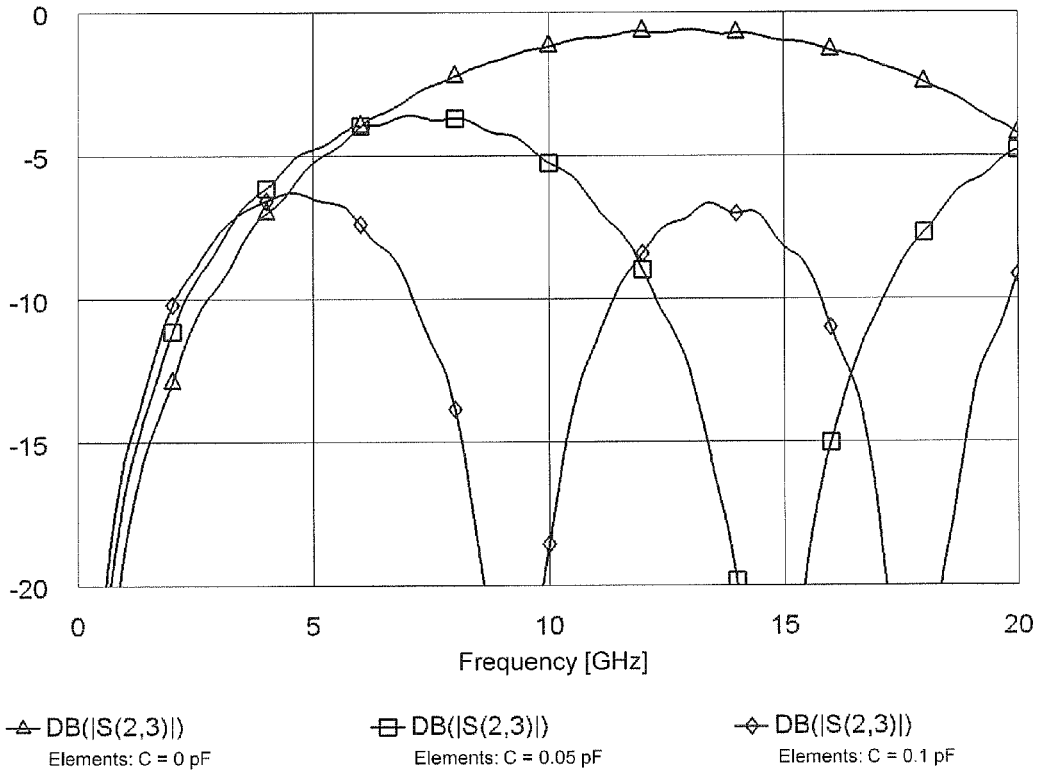
FIG. 8 an alternative transmission characteristic to FIG. 7 of the line system illustrated in FIG. 6.

FIG. 8 shows an alternative transmission behavior to that of FIG. 7 for the two-port shown in FIG. 6, whereas only the imaginary value of the impedance of the controllable elements E is varied by changing the capacitance value C. The capacitance value C of the controllable elements E is varied from 0 femtofarads to 100 femtofarads. The characteristic with the triangles corresponds to 0 femtofarads, the characteristic with the squares corresponds to 50 femtofarads and the characteristic with the rectangles tilted onto their corner to 100 femtofarads. With increasing capacitance, the frequency at which the attenuation is low for the first time, decreases. Accordingly, the two-port controlled in this manner, as shown in FIG. 6, can be used as a controllable band-pass and/or controllable band-stop.

By controlling both the real and also the imaginary impedance of the controllable elements E, the transmission behavior can be advantageously further adjusted. A further improvement of the transmission behavior can be achieved through different control of the controllable elements E. Furthermore, with a corresponding choice of the impedance $Z_{L1}$ at terminal $T_1$ and the impedance $Z_{L2}$ at terminal $T_4$, the transmission behavior of the two-port can be advantageously further adapted.

Figure 9:
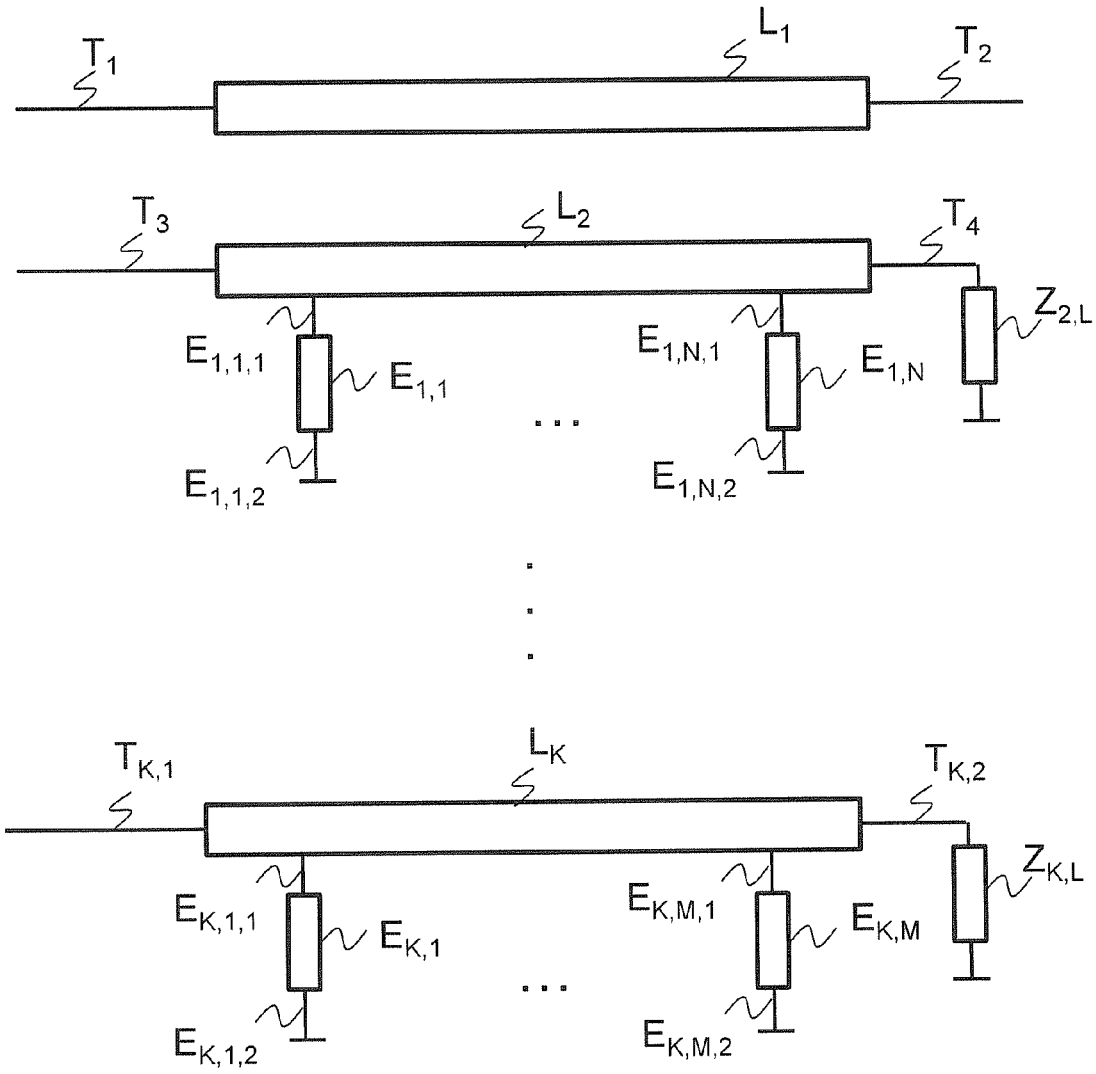
FIG. 9 a further development according to the invention of the line system illustrated in FIG. 1.

FIG. 9 shows a further development of the line system according to the invention as shown in FIG. 1. By way of difference from FIG. 1, in FIG. 9, further lines $L_K$ are provided, which are coupled in a similar manner to the lines $L_1$ and $L_2$. Only one further line $L_3$ may also be present, in this regard, see, for example, FIG. 20. The first line $L_1$ should also be operated without controllable elements, as in FIG. 1.

In FIG. 9, the second terminals $T_4$ to $T_{K,2}$ of the lines $L_2$ to $L_K$ are terminated with load impedances $Z_{2,1}$, to $Z_{K,L}$. The line system according to the invention configured in this manner represents a switch. The inputs of the switch are, in each case, the first terminals $T_1$, $T_3$ to $T_{K,1}$ of the lines $L_1$ to $L_K$. The output of the switch is the second terminal $T_2$ of the first line $L_1$. The switch can also be operated in a reciprocal manner, whereas the second terminal $T_2$ of the first line $L_1$ is the input and, in each case, the first terminals $T_1$, $T_3$ to $T_{K,1}$ of the lines $L_1$ to $L_K$ are the outputs.

Figure 10:
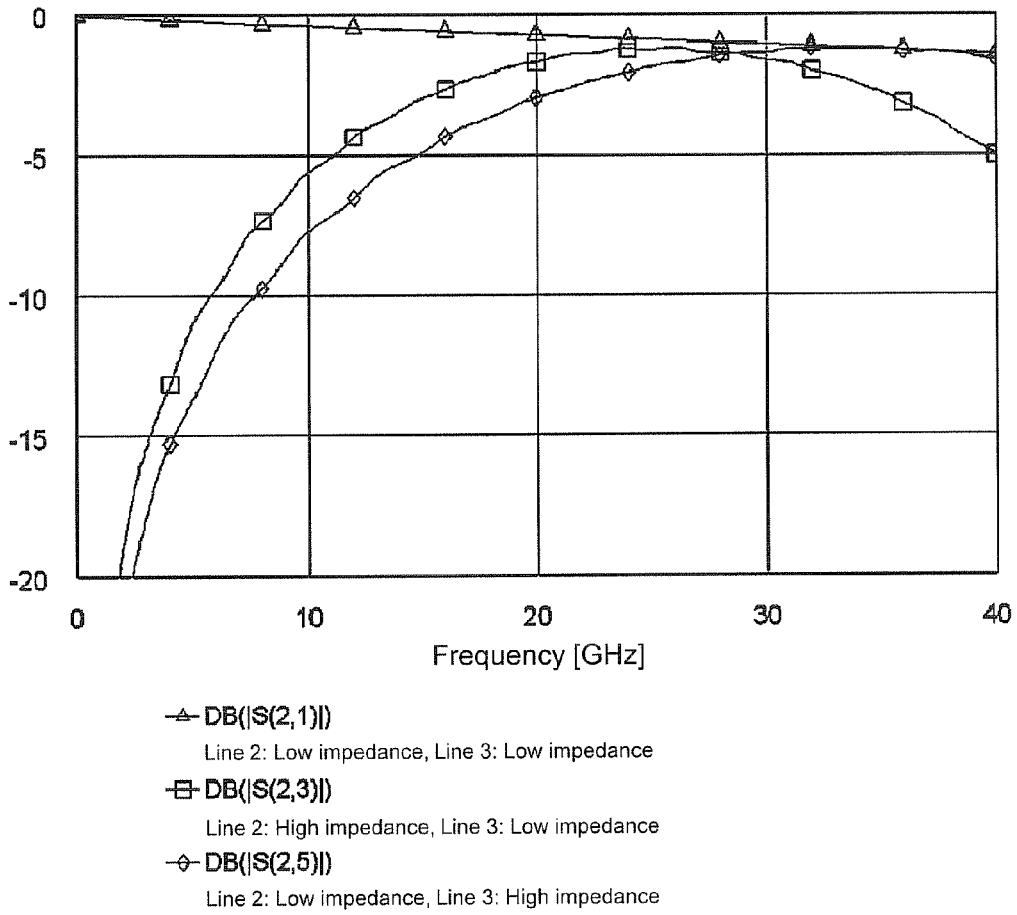
FIG. 10 a transmission characteristic of the line system illustrated in FIG. 9.

FIG. 10 shows the transmission behavior of a switch as shown in FIG. 9, for example, with three lines $L_1$, $L_2$ and $L_3$. The number of the lines L according to the invention in this context is not restricted to three. If the controllable elements E of the second lines $L_2$ and of the third line $L_3$ are controlled to a low impedance, a signal can be transmitted from the first terminal $T_1$ of the first line $L_1$ to the second terminal $T_2$ of the first line $L_1$ from DC voltage up to 40 GHz with low insertion loss. The corresponding characteristic is marked in FIG. 10 with triangles. If the controllable elements E of the second lines $L_2$ are controlled to a high impedance, and the controllable elements E of the third line $L_3$ to a low impedance, an electromagnetic signal can be transmitted with low insertion loss from the first terminal $T_3$ of the second line $L_2$ to the second terminal $T_2$ of the first line $L_1$ through constructive superposition of the even mode and the odd mode. Correspondingly, an electromagnetic signal can be transmitted with low insertion loss from the first terminal $T_5$ of the third line $L_3$ to the second terminal $T_2$ of the first line $L_1$, if the controllable elements E of the second lines $L_2$ are controlled to a low impedance and the controllable elements E of the third line $L_3$ to a high impedance. The characteristic for the S parameters from the first terminal $T_3$ of the second line $L_2$ to the second terminal $T_2$ of the first line is shown with squares, and the characteristic for the S parameters from the first terminal $T_5$ of the third line $L_3$ to the second terminal $T_2$ of the first line $L_1$ is characterized with rectangles tilted onto their corners. Accordingly, the line system is dimensioned in such a manner that, from the second line $L_2$ to the first line $L_1$, a low insertion loss is achieved from 20 to 30 GHz. From the third line $L_3$ to the first line $L_1$, a low insertion loss is achieved from 30 to 40 GHz. Accordingly, three frequency ranges can be combined with the switch without a frequency gap, with low insertion loss. The frequency at which the signal transmission from one line to the other occurs can be specified through corresponding dimensioning of the line system. The longer the lines L and the higher the difference between the phase velocities of the even mode and the odd mode are, the lower this frequency is.

FIG. 9 additionally shows that the number of lines coupled to one another is not limited to two lines $L_1$ and $L_2$. Additionally, all lines $L_2$ up to $L_K$ apart from the first line $L_1$ can be configured in each case through different elements E, especially PIN diodes, field-effect transistors, bipolar transistors, varactors and/or electromagnetic switches along the lines $L_2$ up to $L_K$.

The switch according to the invention as shown in FIG. 9 can be used in an analogous manner to the line system in FIG. 1 for very high radio-frequency power levels. Furthermore, the nonlinear distortions and the video crosstalk are low. The switch can be used from DC voltage up to very high frequencies.

Figure 11:
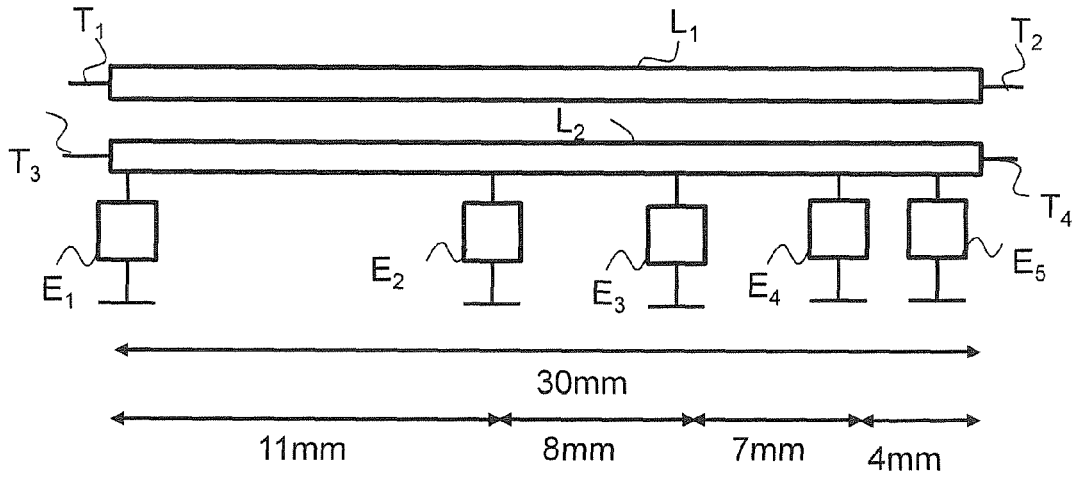
FIG. 11 a fourth exemplary embodiment of a line system according to the invention.

FIG. 11 shows an alternative exemplary embodiment of a line system according to the invention. In this context, five controllable elements $E_1$ to $E_5$ are connected along the second line $L_2$, which are arranged within 30 mm. The controllable element $E_1$ has a distance of 11 mm from controllable element $E_2$, the controllable element $E_2$ a distance of 8 mm from controllable element $E_3$, the controllable element $E_3$ a distance of 7 mm from controllable element $E_4$ and the controllable element $E_4$ a distance of 4 mm from controllable element $E_5$.

Figure 12:
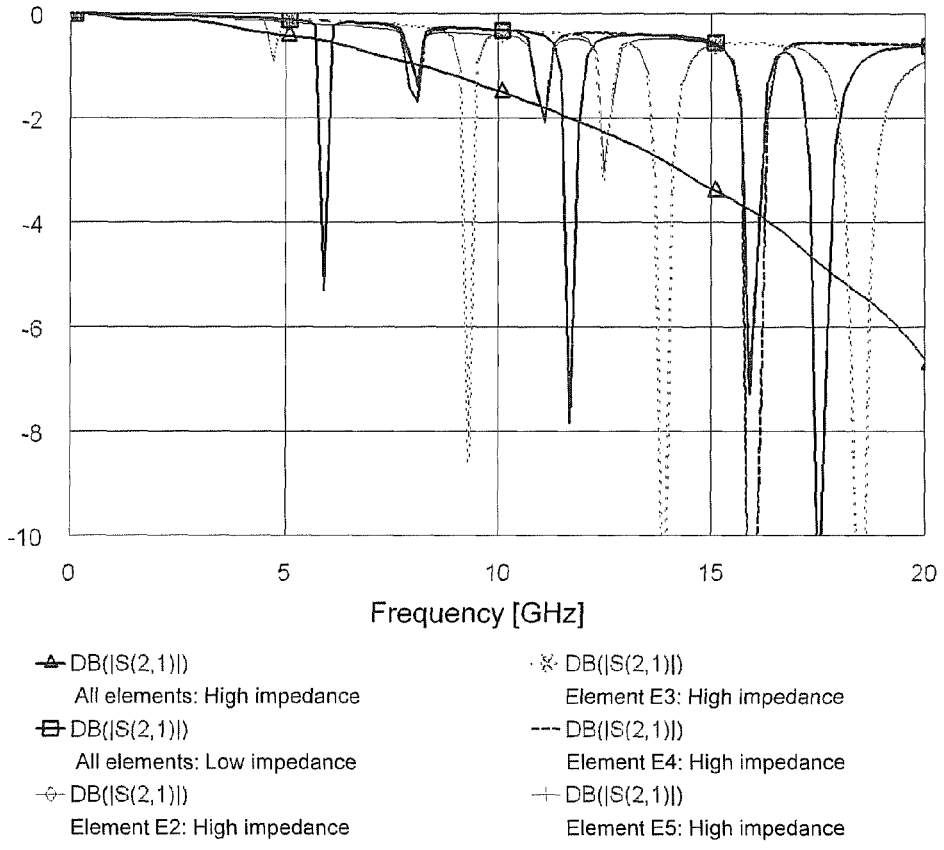
FIG. 12 a transmission characteristic of the line system illustrated in FIG. 11.

FIG. 12 shows transmission characteristics of the line system illustrated in FIG. 11. The S parameters S(2, 1) from terminal $T_1$ to terminal $T_2$ are illustrated by a line with triangles, whereas all controllable elements $E_1$ to $E_5$ provide a high impedance value. It is unambiguously shown that, with such a control of the controllable elements $E_1$ to $E_5$, the S parameters S(2, 1) from terminal $T_1$ to terminal $T_2$ provide a insertion loss rising strongly at high frequencies, while, at very low frequencies or with DC voltage, the signal to be transported experiences almost no insertion loss through the line system.

In FIG. 12, the S parameters S(2, 1) of the line system according to the invention as shown in FIG. 11 from terminal $T_1$ to terminal $T_2$ are illustrated by a line with squares, whereas all controllable elements $E_1$ to $E_5$ provide a low impedance value. It is unambiguously evident that, with such a control of the controllable elements $E_1$ to $E_5$, the S parameters S(2, 1) from terminal $T_1$ to terminal $T_2$ provide several high attenuations at different positions of the frequency response. Since the controllable elements $E_1$ to $E_5$ provide a low impedance, the line segments of the second line $L_2$ between the controllable elements $E_1$ to $E_5$ together with the controllable elements $E_1$ to $E_5$ form so-called line resonators. In this context, the resonance frequencies of the line segments depend upon their lengths. At these resonance frequencies, a high attenuation occurs from terminal $T_1$ to terminal $T_2$.

Furthermore, FIG. 12 shows the S parameters S(2, 1) from terminal $T_1$ to terminal $T_2$ with a line of rectangles tilted onto their corners, whereas only the controllable element $E_2$ is controlled to a high impedance, and the other controllable elements $E_1$, $E_3$, $E_4$ and $E_5$ have a low impedance.

Furthermore, the S parameters S(2, 1) from terminal $T_1$ to terminal $T_2$ are illustrated with a line of inverted triangles, whereas only the controllable element $E_3$ is controlled to a high impedance, and the other controllable elements $E_1$, $E_2$, $E_4$ and $E_5$ have a low impedance.

Furthermore, the S parameters S(2, 1) from terminal $T_1$ to terminal $T_2$ are illustrated by a line without symbols, whereas only the controllable element $E_4$ is controlled to a high impedance, and the other controllable elements $E_1$, $E_2$, $E_3$ and $E_5$ have a low impedance.

Furthermore, the S parameters S(2, 1) from terminal $T_1$ to terminal $T_2$ are illustrated with a line with vertical dashes, whereas only the controllable element $E_5$ is controlled to a high impedance, and the other controllable elements $E_1$ to $E_4$ have a low impedance.

It is evident that the S parameters S (2, 1) from terminal $T_1$ to terminal $T_2$ provide several high attenuations. Dependent upon the control of the elements $E_1$ up to $E_5$, the high attenuations occur at different frequencies. This is attributable to the fact that the length of the line resonators on the line $L_2$ is varied through different control of the controllable elements $E_1$ to $E_5$. Through an advantageous control of the controllable elements $E_1$ to $E_5$, a low insertion loss from terminal $T_1$ to terminal $T_2$ can thus be achieved from DC voltage up to 20 GHz. In this context, the control of the controllable elements $E_1$ to $E_5$ is implemented dependent upon the frequency to be transmitted.

With the line system according to the invention shown in FIG. 11, it is shown that the transmission behavior of the line system can be varied in an advantageous manner through different control of the controllable elements $E_1$ to $E_5$. A further improvement of the transmission behavior can be achieved if different controllable elements $E_1$ to $E_5$ are used and/or the controllable elements can be controlled to a plurality of impedance values.

In the exemplary embodiments according to the invention of FIGS. 1, 4, 6, 9, 11, the DC control voltage can be applied at the terminals of the second line $L_2$, respectively in the corresponding further lines $L_3$ to $L_K$. Alternatively, the DC control voltage is supplied internally to the controllable element E, especially by means of a separate control terminal St. The supply of the DC voltage can be implemented, for example, with a resistor R, an inductor L and/or a bonding wire. For the decoupling of the DC control voltage, coupling capacitors $C_{couple}$ can be used. In particular, the controllable element E can contain a PIN diode, a field-effect transistor, a bipolar transistor, a varactor and/or an electromagnetic switch. Exemplary embodiments of the controllable elements are illustrated in FIGS. 29*a-m*. The controllable elements E can be different. The controllable elements E can be controlled altogether, in groups or individually.

Figure 13:
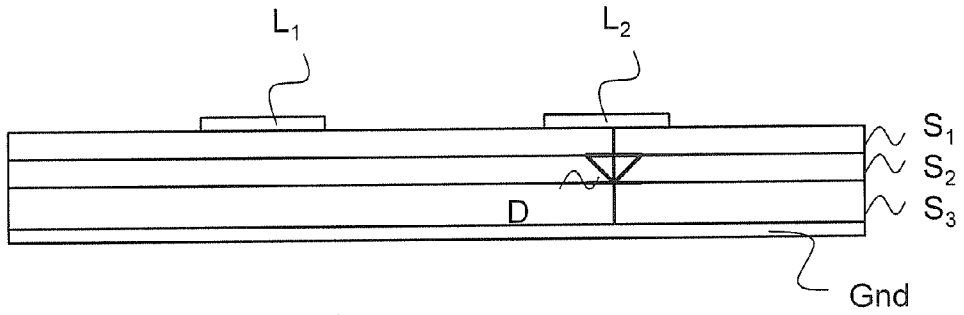
FIG. 13 a fifth exemplary embodiment of a line system according to the invention with a layered substrate construction.

FIG. 13 shows a further exemplary embodiment of a line system according to the invention. In this context, the carrier substrate on which the line system according to the invention with the lines $L_1$ and $L_2$ is arranged is formed from several different layers $S_1$ to $S_3$, or alternatively, only from one layer. The reference potential Gnd is embodied over the whole area of the lower side of the substrate.

The odd mode of the electromagnetic signal is propagated above the carrier substrate and within the carrier substrate, while the even mode is propagated primarily within the carrier substrate. Accordingly, the phase velocity of the even mode is different from the phase velocity of the odd mode. The layers $S_1$ to $S_3$ provide different electrical dielectric constants $\epsilon_r$ and/or relative magnetic permeabilities $\mu_r$, so that the difference between the phase velocity of the even mode and the phase velocity of the odd mode is varied. In consequence, the transmission characteristic of the coupled line system varies. The construction with the lines above the carrier substrate and the reference potential over the full area of the lower side of the carrier substrate, as shown in FIG. 13, corresponds to a microstrip line system. In this context, the controllable element E according to the invention is arranged between the line $L_2$ and the reference potential Gnd, which is disposed below the substrate S. The connection to the reference potential Gnd below the substrate S can be made directly through a controllable element E, for example, a PIN diode D, or through an electrical via through the substrate.

As an alternative—not illustrated here—the line system according to the invention is embodied as a coplanar-line system, whereas both the lines $L_1$ and $L_2$ and also the reference potential Gnd are embodied on an upper side of the carrier substrate. As a variant, the coplanar-line system can additionally have the reference potential over the full area of the lower side of the carrier substrate. Accordingly, in conformity with the idea of the invention, the at least one controllable element E is arranged between the line $L_2$ and the reference potential, which is disposed below the substrate, or alternatively above the substrate on the side with the lines $L_1$, $L_2$. The connection to the reference potential Gnd below the substrate can be implemented directly by the controllable element E, for example, a PIN diode D, or by an electrical via through the substrate.

Alternatively, and not illustrated here, the line system according to the invention is embodied as a stripline system. In the stripline system, the lines L are disposed in the carrier substrate. The reference potential Gnd is disposed above and below the carrier substrate. To ensure that the phase velocities of the even mode and the odd modes differ, the layers of the carrier substrate must provide different electrical dielectric constants $\epsilon_r$ and/or relative magnetic permeabilities $\mu_r$. Since the second line $L_2$ is in the carrier substrate and not on the surface of the carrier substrate, the controllable element E must be disposed in the carrier substrate. Alternatively, the controllable element E is disposed on the surface of the carrier substrate, and the connection to the second line $L_2$ is implemented with an electrical via.

Figure 14:
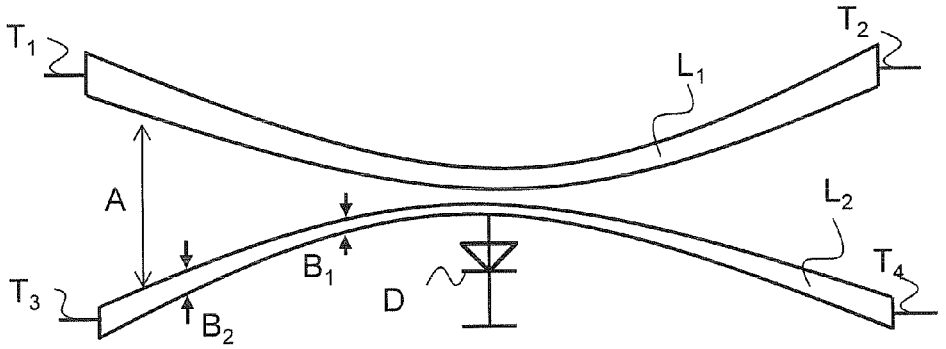
FIG. 14 a sixth exemplary embodiment of a line system according to the invention with position-dependent line geometry.

FIG. 14 shows a line system according to the invention with lines $L_1$ and $L_2$. In this context, the line system is embodied with convex curved lines $L_1$ and $L_2$. A concave curved embodiment of the lines $L_1$ and $L_2$ is not illustrated but is also covered within the idea of the invention. With such a curve of the lines $L_1$ and $L_2$, a position-dependent variation of the distance A between the lines $L_1$ and $L_2$ is achieved. Additionally, the line width of the lines $L_1$ and $L_2$ can vary in a position-dependent manner along the lines. This is suggested by the arrows $B_1$ and $B_2$, whereas the width $B_1$ of the line $L_2$ is smaller than the width $B_2$. Furthermore, the line width of line $L_1$ can be different from the line width of line $L_2$. The distance of the lines from the lateral reference potential Gnd, not illustrated here, can also vary in a position-dependent manner along the lines. The distance of the lines from the reference potential can be different for line $L_1$ and $L_2$. These position-dependent geometric variations of the lines $L_1$, $L_2$ lead to a change in the phase velocity of the odd mode in comparison with the phase velocity of the even mode and a modified transmission behavior of the line system. The line system according to the invention provides at least one controllable element E, of which the impedance value can be controlled, thereby achieving the effects already described in the transmission behavior of the line system.

FIGS. 15*a* to 15*d* show alternative embodiments of the lines $L_1$ and $L_2$ according to the invention, in which the lines $L_1$ and $L_2$ also provide line structures in addition to the controllable elements E, in order further to vary the transmission behavior of the line system.

Figure 15A:
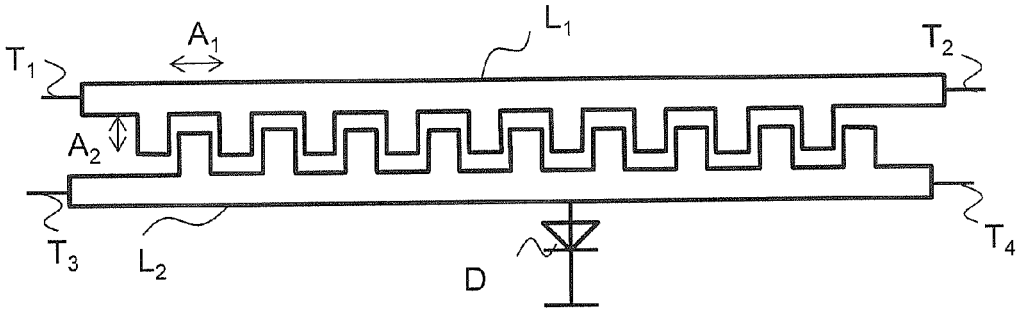
FIGS. 15*a*-15*d* exemplary embodiments of line systems according to the invention with line structures.

According to FIG. 15*a*, line elements are arranged transversely to the lines $L_1$ and $L_2$ and in the intermediate space between the lines $L_1$ and $L_2$. The line segments can interlock with one another. The electromagnetic field between the lines $L_1$ and $L_2$ and the electromagnetic field relative to the reference potential Gnd, which is not illustrated, are varied through the line segments. These lines $L_1$ and $L_2$ embodied in a comb-like structure thus vary the difference between the phase velocity of the odd mode and the phase velocity of the even mode on the lines $L_1$ and $L_2$.

Figure 15B:
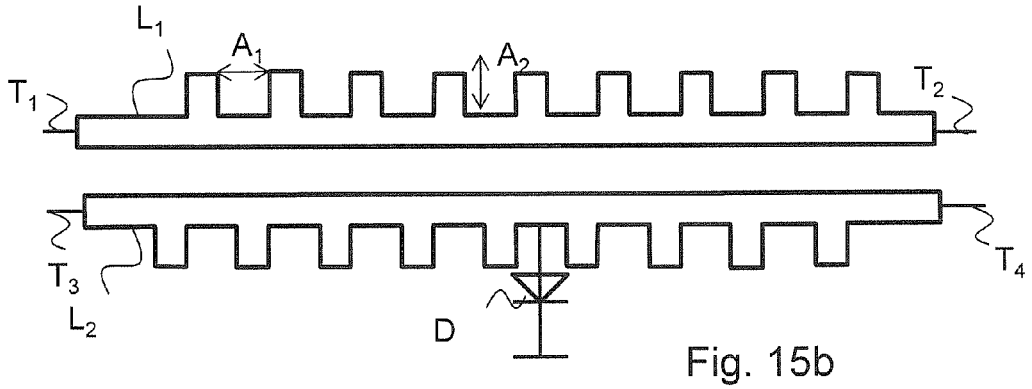

According to FIG. 15*b*, as the only difference by comparison with FIG. 15*a*, the line segments of line $L_1$ are embodied transversely, facing away from line $L_2$ and disposed outside the intermediate space between the lines $L_1$ and $L_2$. The line segments of the line $L_2$ are embodied respectively.

The line segments from FIG. 15*a* and FIG. 15*b* are not restricted either in their number, their distance $A_1$ from one another or in their length $A_2$. These elements additionally have inductive or capacitive properties and therefore vary the characteristic impedance of the line system according to the invention.

Figure 15C:
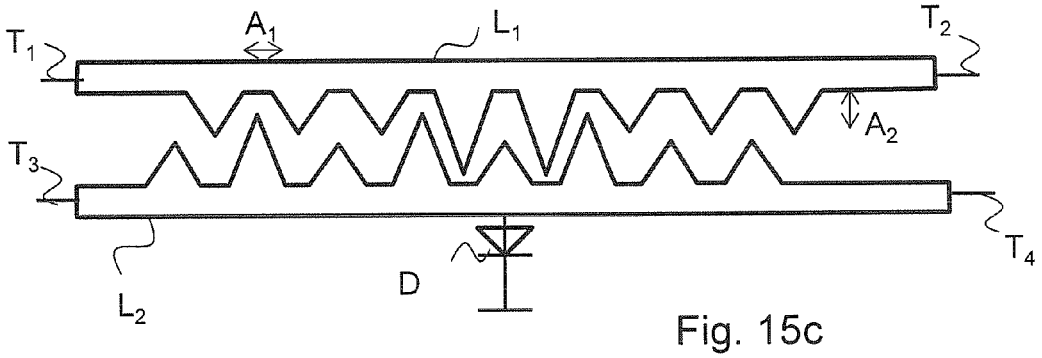

In contrast with FIG. 15*a*, FIG. 15*c* shows the lines $L_1$ and $L_2$ as a zigzag structure. A zigzag structure corresponding to FIG. 15*b*, which is not excluded from the idea of the invention, has not been illustrated. The zigzags, as elements from FIG. 15*c*, are not restricted in their number, their distance $A_1$ from one another or their length $A_2$. In particular, the zigzags may be shaped differently.

Figure 15D:
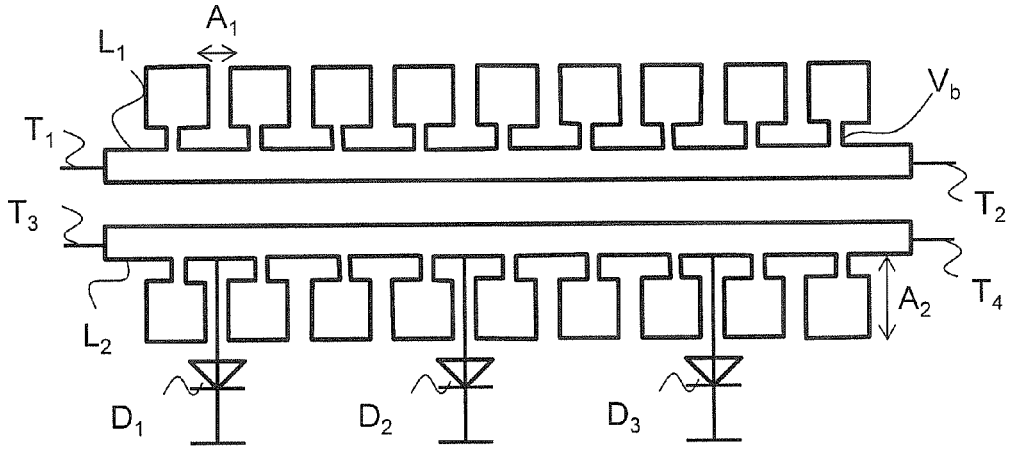

FIG. 15*d* shows an alternative embodiment of the line segments. In this context, the line segments are embodied in a rectangular shape, however, by contrast with FIG. 15*b*, connected to the lines $L_1$ and $L_2$ by means of a connection $V_b$ relatively thinner than the rectangular line segments. A structure with these line segments between the lines corresponding to FIG. 15*a*, which is not excluded from the idea of the invention, is not illustrated. The rectangular elements from FIG. 15*d* are not restricted in their number, their distance $A_1$ from one another or their length $A_2$.

In the exemplary embodiments shown in FIGS. 15*a* to 15*d*, the line structures influence the transmission behavior of the coupled lines through additional variation of the difference in the phase velocity of the even mode relative to the phase velocity of the odd mode of the signal fed in. In particular, a relatively lower insertion loss of the line system is realized for a relatively wider frequency range. Each line system according to the invention illustrated in FIGS. 15*a* to 15*d* provides at least one controllable element E, of which the impedance value can be controlled, thereby varying the transmission behavior of the line system according to the invention.

Figure 16A:
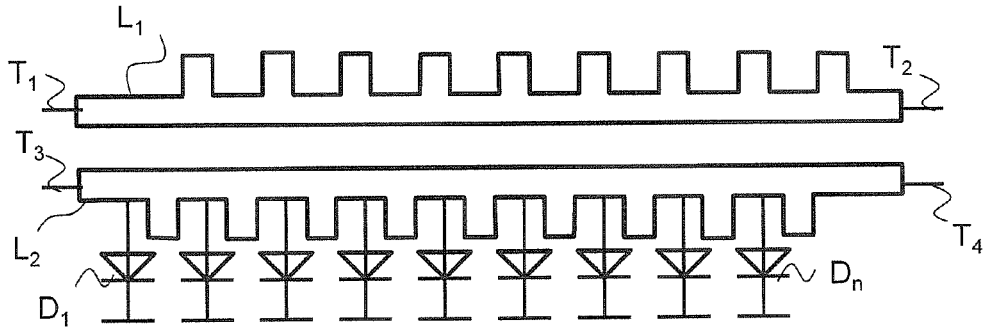
FIGS. 16*a*-16*b* alternative exemplary embodiments to FIGS. 15*a*-15*d* of a line system according to the invention with line structures.
Figure 16B:
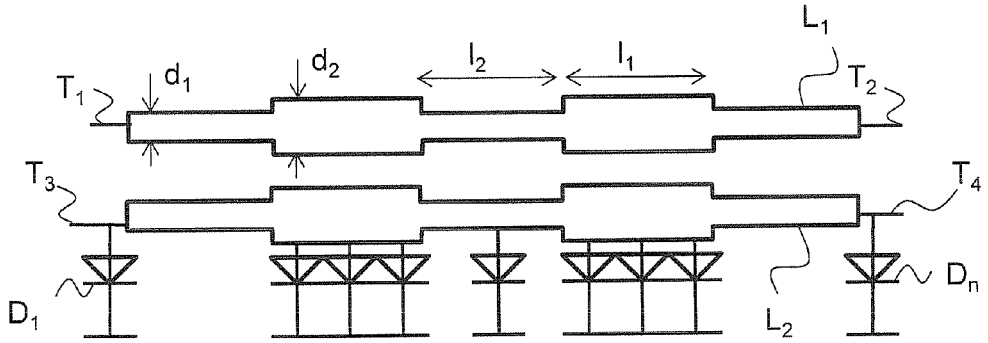

The illustrations of the invention in FIGS. 16*a* and 16*b* show that the introduction of a plurality of controllable elements E improves the transmission behavior of the line system corresponding to the requirements.

FIG. 16*a* shows the exemplary embodiment of FIG. 15*b* with the difference that, instead of one controllable element E, a plurality of controllable elements are connected to the second line $L_2$. Accordingly, between each of the line segments of the second line $L_2$, a PIN diode $D_n$ is connected with a first terminal $D_{n,1}$ to the line $L_2$. The second terminal $D_{n,2}$ of the diode $D_n$ is connected to the reference potential Gnd of the signal fed in. A line system capable of fine tuning is achieved through individual control of every individual controllable element E.

In FIG. 16*b*, position-dependent local line widenings of the lines $L_1$ and $L_2$ are provided. Accordingly, lines $L_1$ and $L_2$ provide either the line width $d_1$ or the line with $d_2$. The local line widenings are not restricted in number, distance $l_2$ from one another or their length $l_1$. An exemplary embodiment in which only line $L_1$ or line $L_2$ provides a line widening is not excluded from the idea of the invention. Alternatively, at least one of the lines $L_1$ or $L_2$ provides a tapering.

By way of example, three PIN diodes D are arranged in each case in the line widenings. Additionally, PIN diodes D are also arranged in the narrow line segments. At the beginning and at the end of the second line $L_2$, accordingly at terminal $T_3$ and at terminal $T_4$ a PIN diode D is arranged in each case as a controllable element. This is intended to illustrate that it is not excluded from the idea of the invention that, in addition to the controllable elements E distanced from the terminals on the line L2, controllable elements E can also be disposed directly at the first terminal $T_3$ of the line $L_2$ and at the second terminal $T_4$ of the line $L_2$.

Figure 17:
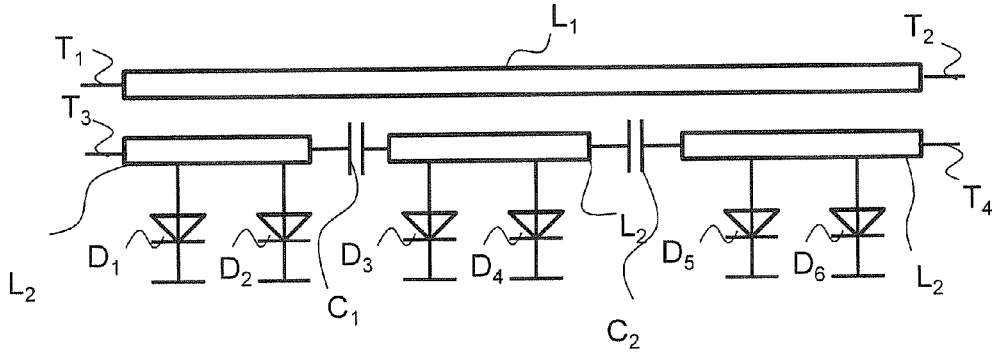
FIG. 17 an alternative exemplary embodiment of a line system according to the invention with decoupling capacitor.

FIG. 17 shows an alternative embodiment of the line system according to the invention. Here, the second line $L_2$ is interrupted in two places, whereas the interruption is bridged in each case by means of a coupling capacitor $C_1$, $C_2$. The number of interruptions of the second line $L_2$ is not restricted according to the invention.

As a result of the interruption, the diodes $D_1$ and $D_2$ can be controlled in their impedance value independently from the diodes $D_3$ to $D_6$. For this purpose, a first DC control voltage is applied at the terminal $T_3$ of the second line $L_2$. This DC control voltage controls the impedance of the diodes $D_1$ and $D_2$. The other diodes $D_3$ to $D_6$ are decoupled from this first DC control voltage by the coupling capacitors $C_1$ and $C_2$.

As a result of this interruption, the diodes $D_3$ and $D_4$ can be controlled in their impedance value independently from the diodes $D_1$, $D_2$, $D_5$ and $D_6$ by means of a second DC control voltage. A supply of the second DC control voltage is not shown in FIG. 17. This second DC control voltage controls the impedance of the diodes $D_3$ and $D_4$. The other diodes $D_1$, $D_2$, $D_5$ and $D_6$ are decoupled from this second DC control voltage by the coupling capacitors $C_1$ and $C_2$.

As a result of the interruption, the diodes $D_5$ and $D_6$ can be controlled in their impedance value independently from the diodes $D_1$ to $D_4$. For this purpose, a third DC control voltage is applied at the terminal $T_4$ of the second line $L_2$. This third DC control voltage controls the impedance of the diodes $D_5$ and $D_6$. The other diodes $D_1$ to $D_4$ are decoupled from this third DC control voltage by the coupling capacitors $C_1$ and $C_2$.

Accordingly, the line system according to the invention can be operated in many operating phases, so that the transmission behavior can be adapted to the respective signal to be transported.

Figure 18:
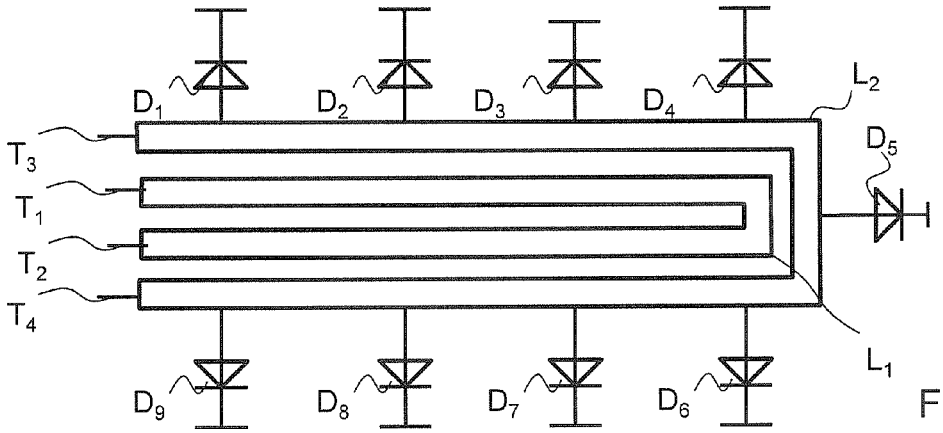
FIG. 18 an alternative exemplary embodiment of a line system according to the invention in a U-shape.

FIG. 18 shows an alternative exemplary embodiment of the line system according to the invention. Here, the lines $L_1$ and $L_2$ are arranged in a U-shape, whereas, in principle, the inner line $L_1$ and the outer line $L_2$ can be exchanged. A plurality of controllable elements E is connected to the second line $L_2$. Arranging the lines $L_1$ and $L_2$ in the manner shown in FIG. 18 also modifies the difference between the phase velocity of the even mode and the phase velocity of the odd mode of the signal fed in and achieves an improved transmission behavior.

Figure 19:
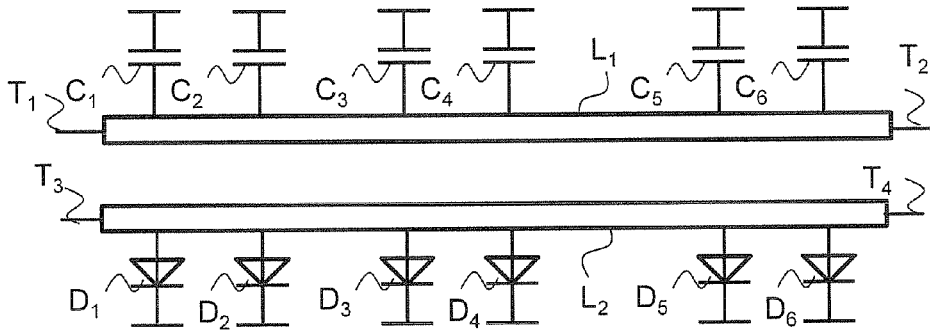
FIG. 19 an alternative exemplary embodiment of a line system according to the invention with compensation elements.

FIG. 19 shows an alternative exemplary embodiment of the line system according to the invention. Non-controllable elements $C_1$ to $C_6$ in the form of capacitors are arranged along the first line $L_1$. These capacitors compensate parasitic capacitances of the controllable elements $E_1$ to $E_6$, especially the junction capacitance of the PIN diodes $D_1$ to $D_6$. As a result, the insertion loss of the line system is further improved. The capacitors $C_1$ to $C_6$ can be connected to the line $L_1$ as discrete components. Alternatively, other components, for example, resistors R of which the parasitic capacitances C correspond to the parasitic capacitances of the controllable elements are used for the compensation. Alternatively, the capacitors are embodied as line structures.

Figure 20:
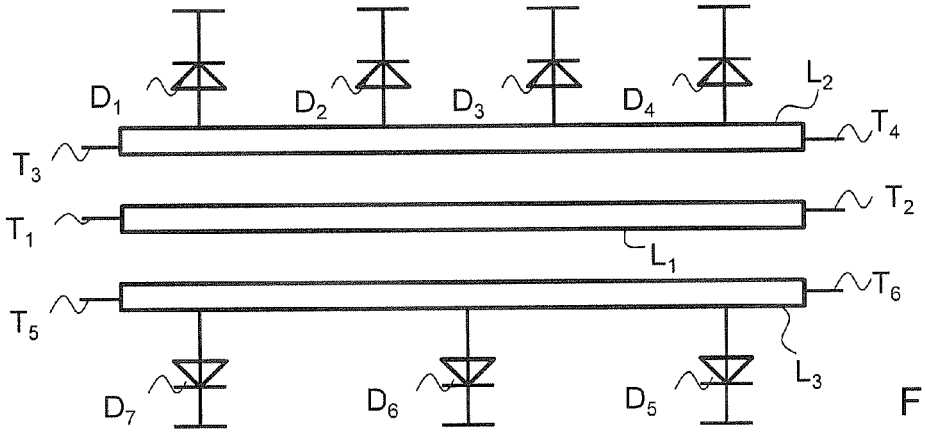
FIG. 20 a further development of the exemplary embodiment according to the invention shown in FIG. 9.

FIG. 20 shows a further development of the line system according to the invention illustrated in FIG. 9. Here, a third line $L_3$ is provided with controllable elements $D_5$ to $D_7$. A signal can also be fed in at the terminal $T_5$ of the line $L_3$, which is tapped after transport via the line system at the output $T_2$ of the line $L_1$. According to the invention, the number and positioning of the controllable elements E in the third line $L_3$ can be different from the second line $L_2$, in order to match the line system to signals which are to be fed in differently at terminals $T_3$ and $T_5$. In this context, the lines $L_1$ to $L_3$ are embodied as microstrip lines, coplanar lines and/or striplines. A signal to be fed in at terminal $T_3$ can differ, especially with regard to the frequency and/or the power level of the signal, from a signal fed in at terminal $T_5$.

Figure 21:
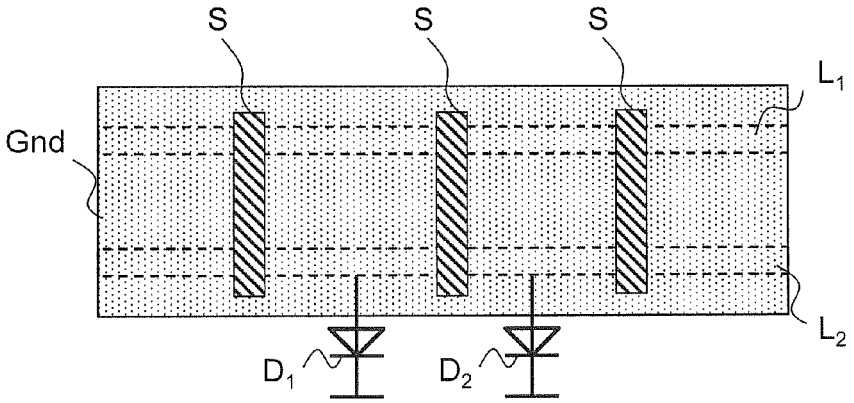
FIG. 21 an alternative exemplary embodiment of a line system according to the invention with transverse slots in the reference potential surface.

FIG. 21 shows an alternative exemplary embodiment of the line system according to the invention. In this context, the reference potential Gnd is embodied as a ground surface on one side of the substrate. The lines $L_1$ and $L_2$ of the line system are embodied as microstrip lines, coplanar lines and/or strip lines. The line type of the line $L_1$ and of the line $L_2$ can be different. For example, the line $L_1$ can be a stripline and the line $L_2$ can be a coplanar line with additional ground surface Gnd on the lower side of the substrate. The lines are only illustrated with dashed lines, since they are embodied on an upper side of the carrier substrate disposed opposite to the ground surface Gnd. The ground surface Gnd provides transverse slots S, of which the number and width can vary. Accordingly, the difference in the phase velocity of the even mode from the phase velocity of the odd mode is varied. The controllable elements E are connected as diodes $D_1$ and $D_2$ between the second line $L_2$ and the ground surface Gnd.

Figure 22:
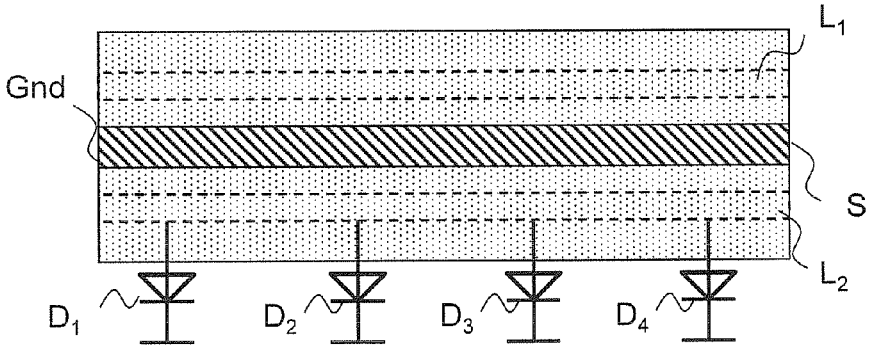
FIG. 22 an alternative exemplary embodiment of a line system according to the invention with a longitudinal slot in the reference potential surface.

FIG. 22 shows an alternative exemplary embodiment of the line system according to the invention. In this context, the reference potential is embodied as a ground surface. The lines $L_1$ and $L_2$ of the line system are embodied as microstrip lines, coplanar lines and/or striplines. The line type of the line $L_1$ and of the line $L_2$ can be different. For example, the line $L_1$ can be a stripline, and the line $L_2$ a coplanar line with additional ground surface on the lower side of the substrate. The lines are only illustrated as dashed lines, since they are embodied on a side of a carrier substrate disposed opposite to the ground surface Gnd, or respectively in the case of a stripline, within the carrier substrate. The ground surface Gnd provides a longitudinal slot S, of which the width can vary. In this manner, the difference in the phase velocity of the even mode from the phase velocity of the odd mode is varied. The controllable elements E are connected as diodes $D_1$ to $D_4$ between the second line $L_2$ and the ground surface Gnd.

Figure 23:
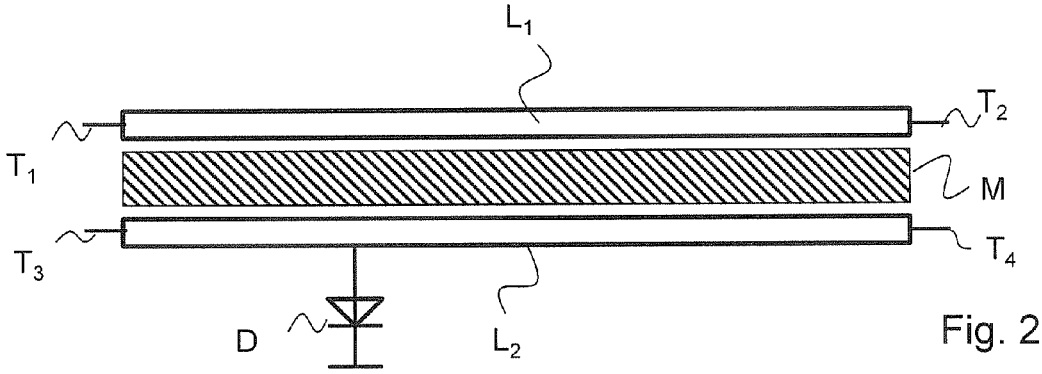
FIG. 23 an alternative exemplary embodiment of a line system according to the invention with additional material with different electrical dielectric constant and/or different relative magnetic permeability.

FIG. 23 shows an alternative exemplary embodiment of the line system according to the invention. In this context, an additional material M is introduced between the lines $L_1$ and $L_2$, of which the electrical dielectric constant $\epsilon_r$ and/or relative magnetic permeability $\mu_r$ differs from that of air. Accordingly, the difference in the phase velocity of the even mode relative to the phase velocity of the odd mode is varied. A controllable element E is connected as a diode D between the second line $L_2$ and the ground surface Gnd.

Figure 24:
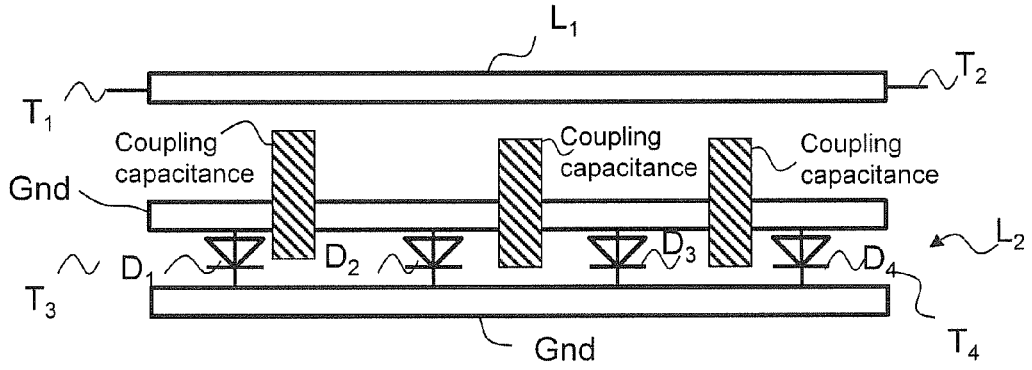
FIG. 24 an alternative exemplary embodiment of a line system according to the invention with a slotline.

FIG. 24 shows an alternative exemplary embodiment of the line system according to the invention. In this context, the first line $L_1$ is embodied as a microstrip line or a coplanar line on an upper side of a substrate or alternatively as a stripline within the substrate. The second line $L_2$ is not embodied as an explicit conductor, but as slotline. For this purpose, a slot is provided in the ground surface Gnd which is disposed above the substrate. A signal fed in then propagates within this slot. The controllable elements E are arranged as diodes $D_1$ to $D_4$ transversely across the slot, that is, from one side of the ground surface to the other side of the ground surface. By controlling the diodes $D_1$ to $D_4$ to a low impedance, the electrical field within the slot of the ground surface is reduced, so that the characteristic impedance of the slotline and accordingly the transmission behavior of the line system is varied. The coupling between the first line $L_1$ and the second line $L_2$ occurs, for example, through the carrier substrate or air above the carrier substrate. Additionally, the coupling can be increased through a further material with high electrical dielectric constant and/or relative magnetic permeability which is introduced in the proximity of the lines, or through coupling capacitors $C_{couple}$. The coupling capacitors $C_{couple}$ can be realized, for example, as line structure, especially through metallic line segments which are disposed on the lower side of the carrier substrate.

Figure 25:
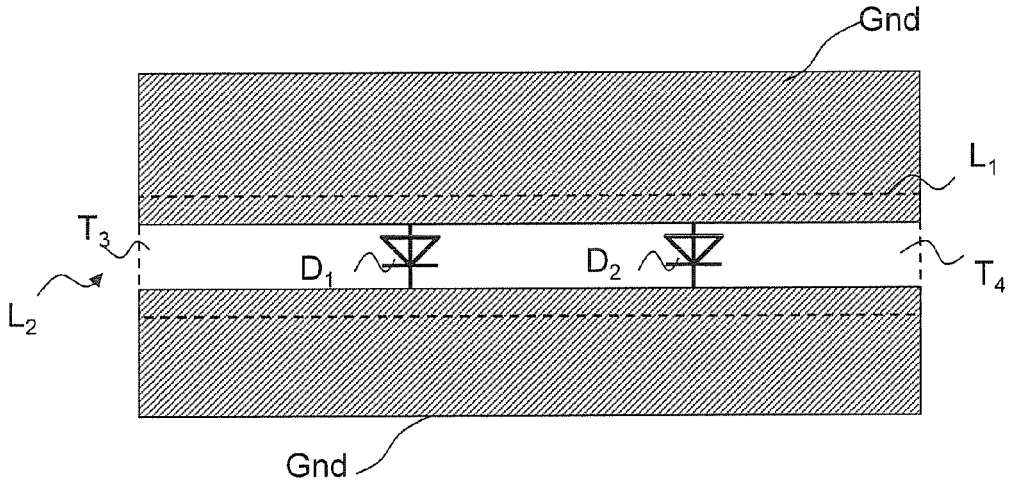
FIG. 25 an alternative exemplary embodiment to FIG. 24 of a line system according to the invention with a slotline.

FIG. 25 shows an alternative exemplary embodiment of the line system according to the invention. In this context, the first line $L_1$ is embodied as a microstrip line or coplanar line on an upper side of a substrate or alternatively as a stripline within the substrate and is only illustrated in dashed lines because of the presentation in plan view. The second line $L_2$ is embodied in a similar manner to FIG. 24 as a slotline. For this purpose, a slot is provided in the ground surface Gnd on the lower side of the substrate. A signal fed in then propagates within this slot. The controllable elements E are arranged as diodes $D_1$ and $D_2$ transversely across the slot, that is, from one side of the ground surface Gnd to the other side of the ground surface Gnd.

Alternatively, and not illustrated here, the line $L_1$ in FIGS. 24 and 25 is embodied as a slotline. The transmission behavior from the first terminal $T_1$ to the second terminal $T_2$ of the first line $L_1$ is then limited downwards by the lower limit frequency of the slotline.

Figure 26:
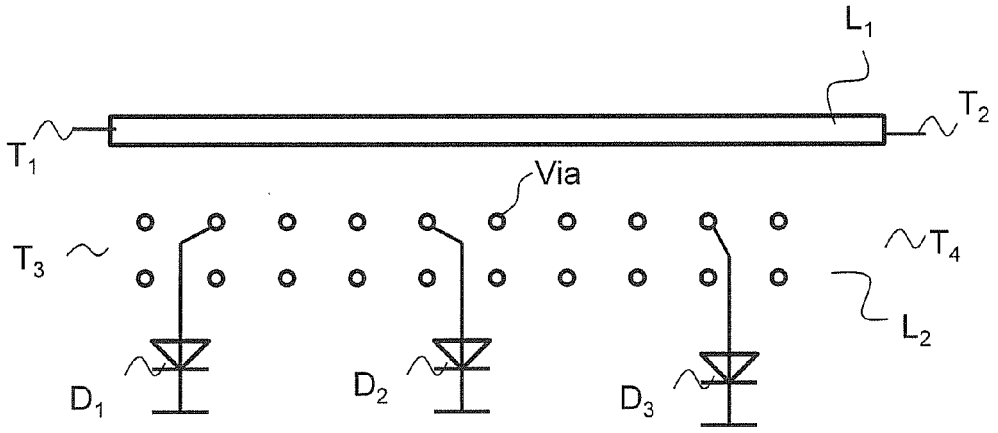
FIG. 26 an alternative exemplary embodiment of a line system according to the invention with an SIW line.

FIG. 26 shows an alternative exemplary embodiment of the line system according to the invention. In this context, the first line $L_1$ is embodied as a microstrip line or a coplanar line on an upper side of a substrate or alternatively as a stripline within the substrate. The second line $L_2$ is not embodied as an explicit conductor but as an SIW. An SIW line comprises a substrate coated in a conducting manner on both sides and electrical vias as a lateral limit. An SIW line is simple to manufacture.

According to the invention, the controllable elements $D_1$ to $D_3$ shown in FIG. 26 are connected to individual vias of the SIW line in order to connect the corresponding via with a controllable impedance to the ground potential Gnd.

Accordingly, the characteristic impedance and the complex propagation constant of the second line $L_2$ and/or the coupling behavior between the two lines $L_1$ and $L_2$ are varied.

Figure 27:
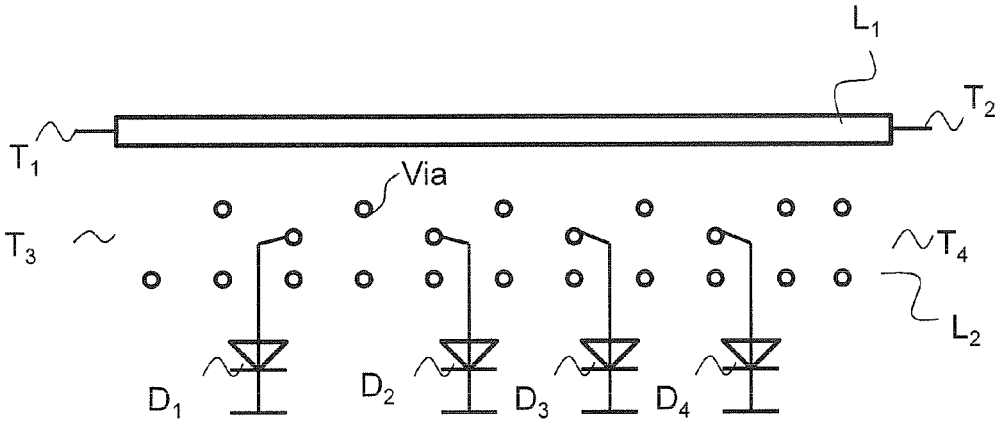
FIG. 27 an alternative exemplary embodiment to FIG. 26 of a line system according to the invention with an SIW line.

FIG. 27 shows an alternative exemplary embodiment of the line system according to the invention to that shown in FIG. 26. By contrast with FIG. 26, individual vias are arranged alternately and connected to a controllable element $D_1$ to $D_4$ in order to connect the corresponding via with a controllable impedance to the ground potential Gnd.

Alternatively, and not illustrated here, the line $L_1$ in FIGS. 26 and 27 is embodied as a slotline or SIW line. The transmission behavior from the first terminal $T_1$ to the second terminal $T_2$ of the first line $L_1$ is then limited downwards by the lower limit frequency of the slotline, or respectively the SIW line.

Figure 28A:
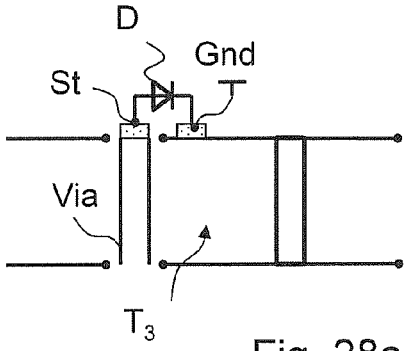
FIGS. 28*a*-*b* an alternative exemplary embodiment to FIGS. 26 and 27 of a line system according to the invention with SIW line.
Figure 28B:
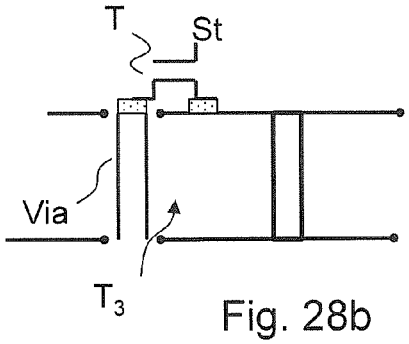

FIGS. 28*a* and 28*b* show embodiments according to the invention which connect the vias by means of a controllable element E to the ground potential Gnd. FIG. 28*a* shows a PIN diode D which is arranged above a via and connected with a first terminal to the via. With a second terminal, the PIN diode D is connected to the reference potential Gnd. In order to vary the impedance of the PIN diode D, a control terminal St is provided, through which a DC control voltage can be applied to the first terminal of the PIN diode D.

Alternatively, FIG. 28*b* shows a transistor T. Here, in particular, a field-effect transistor FET should be used. The FET is arranged above a via and connected with its drain terminal to the via. The source terminal is connected to the reference potential Gnd. The gate terminal of the FET represents a control terminal St to which a DC control voltage can be applied which controls the FET in a variable manner. It is evident that, with the use of SIW lines, the introduction of an FET for the targeted control of the vias can be realized in a simple and cost-favorable manner.

Figure 29A:
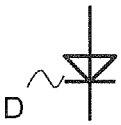
FIGS. 29*a*-29*m* exemplary embodiments of controllable elements according to the invention.

FIGS. 29*a*-29*m* illustrate controllable elements E according to the invention which are shown here only by way of example and will not be described in detail. FIG. 29*a* shows a PIN diode D already mentioned as a controllable element E. The impedance of the PIN diode can be controlled by the DC control current through the PIN diode.

Figure 29B:
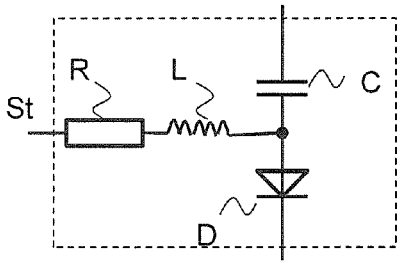

In FIG. 29*b*, the controllable element E comprises a PIN diode D which can be connected at the anode via an inductor L and a resistor R by means of a control terminal St to a DC control voltage. For the decoupling of the DC control voltage St, a coupling capacitor C is provided between the anode of the PIN diode and a terminal to the line $L_2$.

Figure 29C:
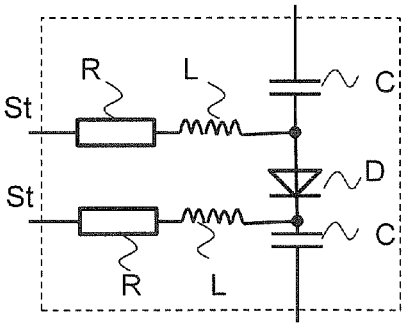

In FIG. 29*c*, the controllable element E also comprises a PIN diode D which can be connected at the anode via an inductor L and a resistor R in series to a first DC control voltage by means of a control terminal St. At the cathode of the PIN diode, an inductor L and a resistor R can be connected in series by means of a control terminal St to a second DC control voltage. A coupling capacitor C is provided both at the anode and also at the cathode of the PIN diode for decoupling the respective DC control voltage.

Figure 29D:
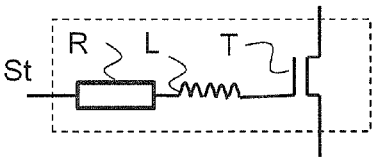

In FIG. 29*d*, the controllable element E comprises an FET T, of which the gate terminal can be connected via an inductor L and a resistor R in series to a DC control voltage by means of a control terminal St. The drain terminal is connected to the second line $L_2$ of the line system. The impedance of the FET is adjusted by the gate-source voltage. In this context, the control voltage is infinitely variable and can accordingly adjust the impedance value of the FET T in an infinitely variable manner.

Figure 29E:
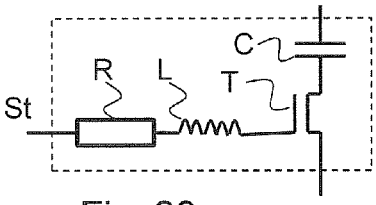

In FIG. 29*e*, the controllable element E also comprises an FET T, of which the gate terminal can be connected via an inductor L and a resistor R in series to a DC control voltage by means of a control terminal St. By way of difference from FIG. 29*d*, the drain terminal is connected via a coupling capacitor to the second line $L_2$ of the line system, in order to decouple the DC control voltage from the line $L_2$.

Figure 29F:
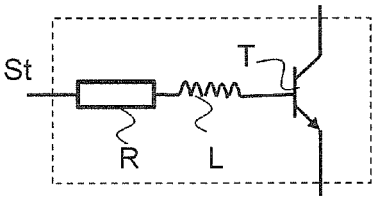
Figure 29G:
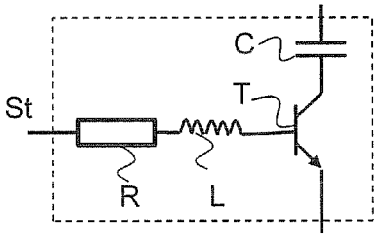

FIGS. 29*f* and 29*g* correspond to FIG. 29*d* and FIG. 29*e*. By way of difference, bipolar transistors are provided as controllable elements E.

Figure 29H:
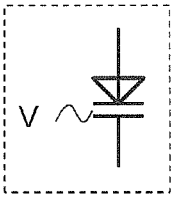

In FIG. 29*h*, varactor V, also designated as a capacitance diode or varicap, is proposed as a controllable element E. In this context, a capacitance value of the varactor V is adjustable via a DC control voltage.

Figure 29I:
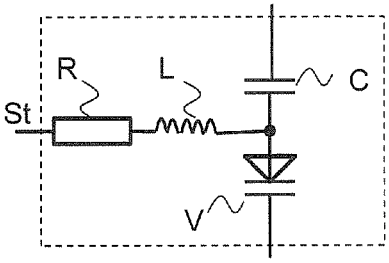

FIG. 29*i* corresponds to FIG. 29*b* and differs through the use of a varactor instead of a PIN diode D.

In FIGS. 29*b*-*g* and 29*i*, the DC control voltage is supplied through a series circuit from a resistor R and an inductor L. The serial sequence of resistor R and inductor L can be exchanged. Furthermore, only a resistor R or also only an inductor L may be used. The DC control voltage can also be supplied with a bonding wire.

In FIGS. 29*j*-*m*, line segments are provided in the controllable elements. In particular, the frequency behavior of the controllable elements can be adapted as a result. There are diverse possibilities for combining the controllable element with line segments. FIGS. 29*j*-*m* represent only a small selection. In each case, a PIN diode is used as the controllable element. Alternatively, an FET, a bipolar transistor or a varactor can be used. The supply of the DC control voltage will not be explicitly explained here. This can occur by analogy with the exemplary embodiments 29*a*-*i*. Furthermore, coupling capacitors for the decoupling of the control voltage will not be explicitly explained. This can also be implemented by analogy with exemplary embodiments 29*a*-*i*.

Figure 29J:
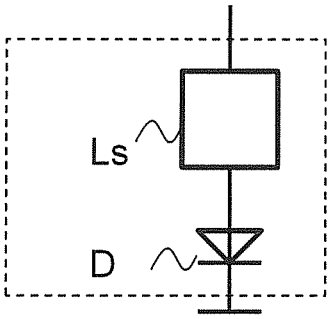

In FIG. 29*j*, a PIN diode D is provided as controllable element E. A line segment Ls with which the controllable element E is connected to the second line $L_2$ is arranged at the anode of the diode D. The cathode of the diode D is connected to the reference potential. An impedance transformation is implemented with the line segment Ls, and accordingly, the frequency behavior of the controllable element is advantageously adapted.

Figure 29K:
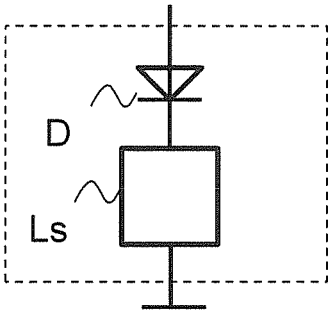

In FIG. 29*k*, by comparison with FIG. 29*j*, the line segment Ls is inserted between the cathode and the diode D and the reference potential. A line transformation is implemented with the line segment Ls.

Figure 29L:
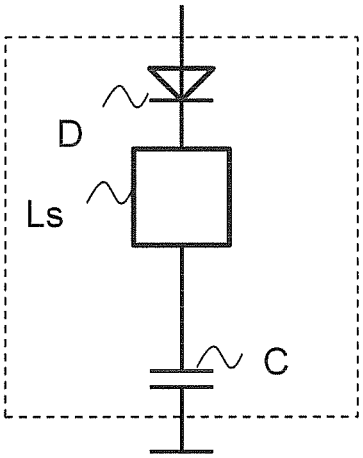

In FIG. 29*l*, a PIN diode D is provided as controllable element E. A line segment Ls is arranged at the cathode of the diode D. The line segment Ls is connected to the reference potential by means of a capacitor. An impedance transformation is implemented with the line segment Ls.

Figure 29M:
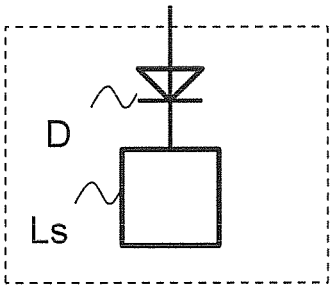

In FIG. 29*m*, by comparison with FIG. 29*l*, no explicit capacitor is present between the line segment Ls and the reference potential. The line segment already provides a significant capacitance relative to the reference potential.

In FIGS. 29*a-m*, the anode terminal and the cathode terminal of the PIN diode and of the varactor are exchangeable. Furthermore, the drain terminal and the source terminal of the FETs and the collector terminal and the emitter terminal of the bipolar transistor are exchangeable.

All of the controllable element E proposed in FIGS. 29*a*-29*m* can be introduced into the exemplary embodiments of the preceding Figs. as controllable element E. In particular, differently embodied controllable elements E from FIGS. 29*a*-29*m* can be introduced into the exemplary embodiments of the preceding Figs.

Within the scope of the invention, all of the elements described and/or illustrated and/or claimed can be combined arbitrarily with one another. In particular, the controllable elements E can be combined arbitrarily with one another. The number of controllable elements E and their distanced arrangement within the respective lines $L_2$ to $L_K$ can vary. The various embodiments of the lines can be combined with one another. The introduction of additional materials with different electrical dielectric constants $\epsilon_r$ and/or relative magnetic permeabilities $\mu_r$ and transportation of the signals in different media and/or substrates is also contained within the idea of the invention.

Although several specific embodiments of the invention have been described and illustrated, the invention is not to be limited to the specific forms or arrangements of parts so described and illustrated. The invention is only limited by the claims.

I claim:

1. A line system with at least two lines each with two terminals, wherein a first line provides respectively a first terminal and a second terminal;

wherein a second line provides respectively a first terminal and a second terminal;

wherein the at least two lines extend in spatial proximity and are coupled;

wherein both the first terminal of the first line and the first terminal of the second line are used for the transmission of signals in a frequency range without frequency gap between the two signals;

wherein the at least two lines transport an electromagnetic signal fed into the line system;

wherein distanced from the first terminal of the second line and distanced from the second terminal of the second line, at least one controllable element is arranged along the second line; and wherein the at least one controllable element is arranged in such a manner that, through the control of the impedance value of the at least one controllable element, the characteristic impedance of the second line or the complex propagation constant of the second line or the coupling between the first line and the second line is significantly varied.

2. The line system according to claim 1, wherein an electromagnetic signal is transmitted between the first terminal of the second line and the second terminal of the first line through a constructive superposition of an even mode and an odd mode of the electromagnetic signal.

3. The line system according to claim 1, wherein the at least one controllable element can be controlled at least between a low impedance value and a high impedance value.

4. The line system according to claim 1, wherein, through a control of an impedance value of the at least one controllable element, a transmission behavior of the line system can be controlled with regard to an attenuation behavior.

5. The line system according to claim 1, wherein, through a control of an impedance value of the at least one controllable element, a superposition of an even mode and an odd mode of the electromagnetic signal is influenced in such a manner that the line system can be controlled with regard to an attenuation behavior.

6. The line system according to claim 1, wherein, through a control of an impedance value of the at least one controllable element, a characteristic impedance and/or a complex propagation coefficient of an odd mode and/or an even mode of the electromagnetic signal is varied.

7. The line system according to claim 1, wherein several controllable elements are arranged along the second line; and wherein the several controllable elements are arranged either equidistantly or at a defined distance from one another.

8. The line system according to claim 1, wherein additional controllable elements are arranged at the first terminal and/or at the second terminal of the second line.

9. The line system according to claim 1, wherein the at least one controllable element is connected with the first terminal to the second line and with the second terminal to a reference potential of the electromagnetic signal.

10. The line system according to claim 1, wherein the first line is free from controllable elements.

11. The line system according to claim 1, wherein the at least one controllable element is controllable dependent upon a frequency of the electromagnetic signal fed in and/or dependent upon a terminal used for feeding in the electromagnetic signal.

12. The line system according to claim 1, wherein the at least one controllable element contains a PIN diode, a field-effect transistor, a bipolar transistor, a varactor, an electromechanical switch, passive elements, and/or line structures.

13. The line system according to claim 1, wherein, for a variation of a transmission behavior of the line system, at least one of the at least two lines has non-controllable elements and/or line structures.

14. The line system according to claim 1, wherein, for a variation of the transmission behavior of the line system, an additional material with a different electrical dielectric constant and/or a relative magnetic permeability is introduced between the at least two lines and/or between the at least two lines and a reference potential.

15. The line system according to claim 1, wherein, for a compensation of parasitic impedances of the at least one controllable element connected along the second line, at least one non-controllable element is connected along the first line, and/or a line structure is disposed along the first line.

16. The line system according to claim 1, wherein, between the at least one controllable elements, at least one coupling capacitor is introduced longitudinally into the second line.

17. The line system according to claim 1, wherein the line system provides at least one third line with respectively a first terminal and a second terminal; and wherein, distanced from the first terminal of the third line and from the second terminal of the third line, the at least one controllable element is arranged along the third line.

18. The line system according to claim 1, wherein at least one slot is embodied in at least one of the at least two lines and/or in a surface connected to a reference potential of the electromagnetic signal.

19. A switch formed by a line system according to claim 1, wherein the first terminal of the first line is a first input of the switch;

wherein the first terminal of the second line is a second input of the switch;

wherein the second terminal of the first line is an output of the switch; and wherein the second terminal of the second line is open or terminated with a load impedance.

20. A switch with a line system according to claim 19, wherein the line system provides at least one further line;

wherein the at least one further line is configured corresponding to the second line, so that the first terminal of the at least one further line is a third input or a third output of the switch, and the second terminal of the at least one further line is open or terminated with a load impedance.

21. A switch formed from a line system according to claim 1, wherein the first terminal of the first line is a first output of the switch;

wherein the first terminal of the second line is a second output of the switch;

wherein the second terminal of the first line is an input of the switch; and wherein the second terminal of the second line is open or terminated with a load impedance.

22. A frequency filter with a line system according claim 1, wherein the second terminal of the second line is open or terminated with a load impedance;

wherein the second terminal of the first line is an input of the frequency filter;

wherein the first terminal of the first line is open or terminated with a load impedance, and the first terminal of the second line is an output of the frequency filter; or wherein the first terminal of the second line is open or terminated with a load impedance, and the first terminal of the first line is an output of the frequency filter.

23. An attenuator with a line system according to claim 1, wherein the second terminal of the second line is open or terminated with a load impedance;

wherein the second terminal of the first line is an input of the attenuator;

wherein the first terminal of the first line is open or terminated with a load impedance, and the first terminal of the second line is an output of the attenuator; or wherein the first terminal of the second line is open or terminated with a load impedance, and the first terminal of the first line is an output of the attenuator.

24. A phase shifter with a line system according to claim 1, wherein the second terminal of the second line is open or terminated with a load impedance;

wherein the second terminal of the first line is an input of the phase shifter;

wherein the first terminal of the first line is open or terminated with a load impedance, and the first terminal of the second line is an output of the phase shifter; or wherein the first terminal of the second line is open or terminated with a load impedance, and the first terminal of the first line is an output of the phase shifter.

* * * * *